US009399531B2

(12) United States Patent
Pryor et al.

(10) Patent No.: US 9,399,531 B2
(45) Date of Patent: Jul. 26, 2016

(54) SHEET INTERLEAVER FOR SLICING APPARATUS

(75) Inventors: Glen F. Pryor, Tinley Park, IL (US); Scott A. Lindee, Mokena, IL (US); James E. Pasek, Tinley Park, IL (US)

(73) Assignee: Formax, Inc., Mokena, IL (US)

( * ) Notice: Subject to any disclaimer, the term of this patent is extended or adjusted under 35 U.S.C. 154(b) by 565 days.

(21) Appl. No.: 12/091,733

(22) PCT Filed: Oct. 25, 2006

(86) PCT No.: PCT/US2006/041616

§ 371 (c)(1), (2), (4) Date: Apr. 25, 2008

(87) PCT Pub. No.: WO2007/050677

PCT Pub. Date: May 3, 2007

(65) Prior Publication Data

US 2008/0250944 A1 Oct. 16, 2008

Related U.S. Application Data

(60) Provisional application No. 60/729,958, filed on Oct. 25, 2005, provisional application No. 60/730,304, filed on Oct. 26, 2005.

(51) Int. Cl.
*B26D 7/06* (2006.01)
*B65B 25/08* (2006.01)
(Continued)

(52) U.S. Cl.
CPC . *B65B 25/08* (2013.01); *B26D 7/27* (2013.01); *B26D 7/325* (2013.01); *B26D 7/32* (2013.01);
(Continued)

(58) Field of Classification Search
CPC ..... B26D 7/27; B26D 7/325; B26D 7/32; B26D 2210/02; B26D 7/14; B26D 5/00; B26D 7/06; B65B 25/08; A47J 43/00
USPC ..... 99/537; 83/76.1, 474, 520, 174, 651, 83/932, 167, 422, 707, 703, 596; 451/45, 451/5; 426/420; 53/435
See application file for complete search history.

(56) References Cited

U.S. PATENT DOCUMENTS 3,481,746 A * 12/1969 Clemens et al. ..... 426/420
3,772,040 A * 11/1973 Benson et al. ..... 426/420
(Continued)

FOREIGN PATENT DOCUMENTS

| | | |
|---|---|---|
| DE | 3230988 | 2/1984 |
| DE | 10011006 | 9/2001 |
| WO | 0176996 | 10/2001 |

OTHER PUBLICATIONS

European Search Report for corresponding application.
(Continued)

*Primary Examiner* — Reginald L Alexander
(74) *Attorney, Agent, or Firm* — Klintworth and Rozenblat IP LLC

(57) ABSTRACT

A sheet interleaver is provided for a slicing machine that includes a slicing plane for slicing an elongated food product and a sheet from web material beneath the elongated product. The interleaver includes a supply of web material, a drawing station, a feed station, and a controller. The drawing station has a first driver for drawing web material from the supply. The feed station has a second driver for receiving web material from the drawing station and driving the web material through a cutting nip into the slicing plane. The controller is in signal-communication with at least one of the first and second drivers to drive web material at select differential speeds by the first and second drivers such that tension between the drawing station and the feed station is controlled to allow a slackened length of web material between the drawing station and the feed station.

15 Claims, 25 Drawing Sheets

(51) Int. Cl.
*B26D 7/27* (2006.01)
*B26D 7/32* (2006.01)

(52) U.S. Cl.
CPC ..... *B26D 2210/02* (2013.01); *Y10T 83/148* (2015.04); *Y10T 83/323* (2015.04); *Y10T 83/664* (2015.04)

(56) References Cited

U.S. PATENT DOCUMENTS 3,889,325 A * 6/1975 Fleissner ..... 26/18.5
3,921,803 A 11/1975 Reed et al.
4,583,435 A 4/1986 Fessler
4,913,049 A 4/1990 Sainio
5,051,268 A * 9/1991 Mally ..... 426/420
5,611,194 A 3/1997 Wildmoser
5,628,237 A 5/1997 Lindee et al.
5,649,463 A 7/1997 Lindee
5,704,265 A 1/1998 Johnson et al.
5,724,874 A 3/1998 Lindee et al.
5,768,959 A * 6/1998 Lorenzo ..... 83/74
6,079,188 A 6/2000 Katayama et al.
6,153,233 A * 11/2000 Gordon et al. ..... 426/90
6,305,145 B2 * 10/2001 Suolahti ..... 53/64
6,408,757 B2 * 6/2002 Ogawa et al. ..... 101/480
6,484,615 B2 11/2002 Lindee
6,616,084 B1 * 9/2003 Sitzmann ..... 242/534
6,698,681 B1 * 3/2004 Guy et al. ..... 242/534
6,752,056 B1 * 6/2004 Weber ..... 83/98
2003/0089209 A1 5/2003 Brueckel et al.

OTHER PUBLICATIONS

Notice of Opposition EP06817369 (May 9, 2012).
Evidence Cited in Notice of Opposition EP06817369 (May 9, 2012).
Patent Document Citations in Notice of Opposition EP06817369 (May 9, 2012).
EPO Communication Re Notice of Opposition in EPEP06817369 (Sep. 18, 2012).
EPO Communication to File Observations in Opposition EPEP06817369 (Dec. 10, 2012).
EPO Notice to Opponents in Opposition EPEP06817369 (Dec. 10, 2012).
International Search Report (May 9, 2008).
Supplemental European Search Report (Aug. 7, 2010).

* cited by examiner

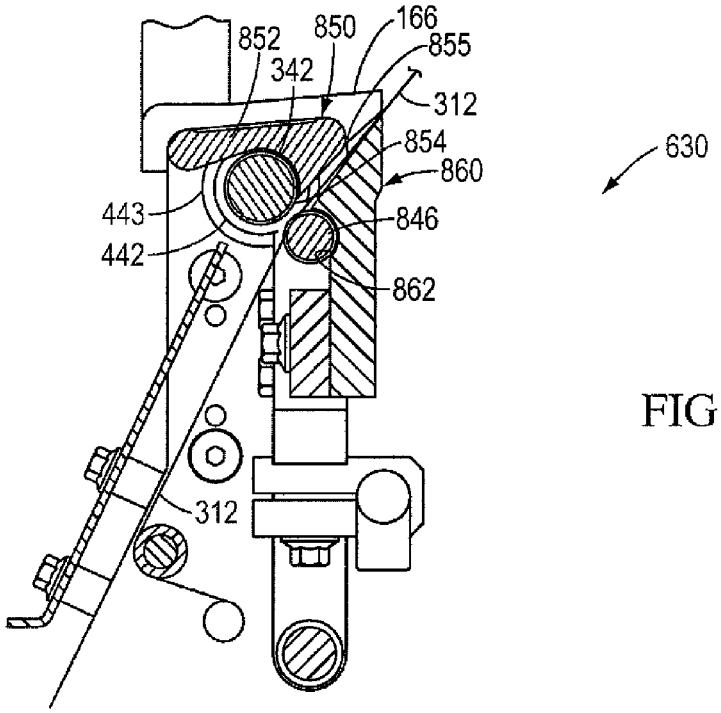
FIG. 23A
FIG. 19A
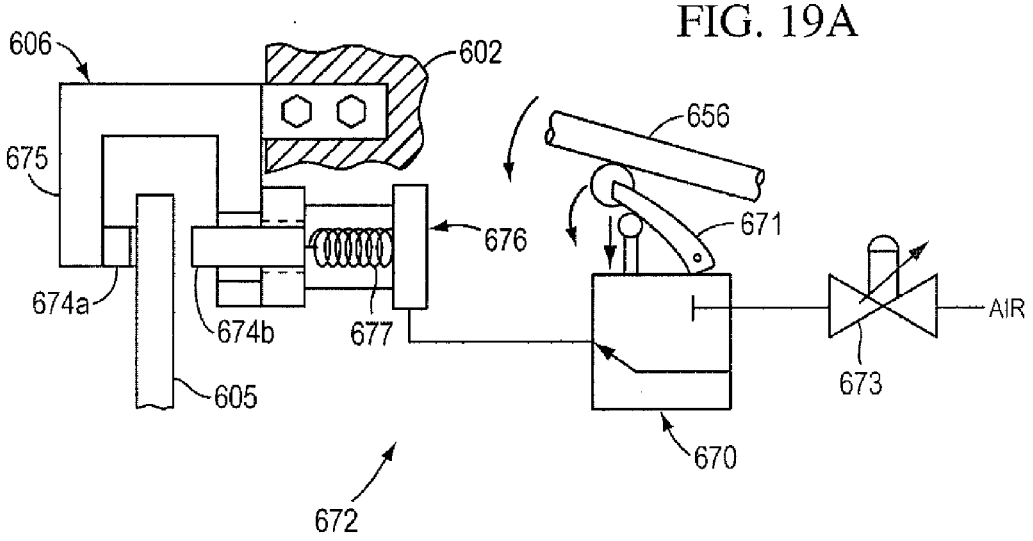

SHEET INTERLEAVER FOR SLICING APPARATUS

CROSS REFERENCE TO RELATED APPLICATIONS

This application is a Section 371 National Stage Application, which claims the benefit of priority from PCT International Application No. PCT/US2006/041616, filed Oct. 25, 2006, which claims the benefit of priority from Provisional Application Ser. No. 60/730,304, filed Oct. 26, 2005 and from Provisional Application Ser. No. 60/729,958 filed Oct. 25, 2005, all of which applications are incorporated by reference herein in their entirety.

BACKGROUND OF THE INVENTION

Food loaves come in a variety of shapes (round, square, rectangular, oval, etc.), cross-sections, and lengths. Such loaves are made from various comestibles, such as meat, cheese, etc. Most loaves are provided to an intermediate processor who slices and packages the products in groups for retail.

A variety of machines have been developed to slice such loaves. Such machines include the FX180™ or the FX Plus™ slicing machines available from Formax, Inc., of Mokena, Ill., USA. The FX180™ and the FX Plus™ machines are high speed food loaf slicing machines that slice one, two, or more food loaves simultaneously using one cyclically driven slicing blade. Independent loaf feed drives are provided so that slices cut from one loaf may vary in thickness from slices cut from the other loaf. The machines include a slicing station that is enclosed by a housing, except for a limited slicing opening. The slicing blade is disposed in the slicing station and a drive rotates the slicing blade at a predetermined cyclical rate on a cutting path through a slicing range that intersects the food loaves as they are fed into the slicing station.

In the foregoing machines, the food loaf slices are received in groups of predetermined weight on a receiving conveyor that is disposed adjacent the slicing blade. The receiving conveyor receives the slices as they are cut by the slicing blade. In many instances, neatly aligned stacked groups are preferred and, as such, the sliced product is stacked on the receiving conveyor before being transferred from the machine. In other instances, the groups are shingled so that a purchaser can see a part of every slice through a transparent package. In these other instances, conveyor belts of the receiving conveyor are gradually moved during the slicing process to separate the slices.

Paper interleaving mechanisms used in conjunction with cutting machines are disclosed in U.S. Pat. Nos. 6,752,056 and 4,583,435. According to these patents, slabs of product such as cheese are oriented angularly with respect to a horizontal conveyor and are fed downwardly into a slicing plane defined by a moving slicing blade. A roll of web material such as paper is arranged beneath the slab and has a length of web continuously fed toward and beneath a cut face of the slab such that when the cutting blade slices a slice from the slab the cutting blade simultaneously slices off a leading end portion of the web, forming a sheet. The sheet with the overlying slice fall to the conveyor or onto a previously cut slice already deposited onto the conveyor to form a stack. The web is continuously fed such that successive sheets are interleaved with successive cut slices.

Both of these patents described the use of air jets to assist in coupling the lead end portion of the web to the front face of the slice to be cut. Both of the patents incorporate driven rollers to dispense the web from a roll of web material.

The present inventors have recognized that it would be desirable to improve the reliability of the placement of sheets for interleaving with product slices, particularly for high-speed slicing operations.

SUMMARY OF THE INVENTION

The present invention provides an improved web dispensing arrangement for interleaving sheets with sliced food product. The invention pertains to high-speed slicing machines wherein web material is dispensed in synchronism with the slicing operation and the leading end portion of the web material is arranged on a downstream side of the cut face of the product and the remaining portion of the web material is arranged on an opposite side of the cutting plane than the leading end portion such that the slicing blade slices not only the product but the leading end portion of the web material. The cut leading end portion of the web material forms a sheet that fronts the cut slice and both fall to a conveyor or onto a stack previously deposited on the conveyor. Thus a stack of interleaved slices and sheets can be formed and conveyed away for packaging.

According to one aspect of the invention, a sheet interleaver is provided for a slicing machine that includes a slicing plane for slicing an elongated food product and a sheet from web material beneath the elongated product. The interleaver includes a supply of web material, a drawing station, a feed station, and a controller. The drawing station has a first driver for drawing web material from the supply. The feed station has a second driver for receiving web material from the drawing station and driving the web material through a cutting nip into the slicing plane. The controller is in signal-communication with at least one of the first and second drivers to drive web material at select differential speeds by the first and second drivers such that tension between the drawing station and the feed station is controlled.

Preferably, the tension is controlled by the controller to allow a slackened length of web material between the drawing station and the feed station that is greater than a straight line distance of the web material spanning between the drawing station and the feed station.

As a further aspect of the invention, a tensioning station is provided between the supply of web material and the drawing station such that tension of the web material between the drawing station and the supply is controlled.

As a further aspect of the invention, a sensor is provided that senses the slackened length of web material between the drawing station and the feed station and is in signal-communication with the controller to adjust the differential speed of the first and second drivers to maintain the slackened length at a pre-selected amount.

As a further aspect of the invention a pressurized air dispenser is provided that is configured to direct an air stream onto a side of the slackened length to maintain a tension on the slackened length of web material.

As a further aspect of the invention, the second driver comprises opposing rollers wherein at least one of the rollers is motor driven and the rollers are pressed together with a resilient interface and roll in opposite directions to form a pinch nip for receiving and driving the web material.

Preferably, the resilient interface is discontinuous along a lateral direction of the pinch nip, wherein one of the opposing rollers comprises annular recesses spaced apart along the lateral direction and a respective other of the opposing rollers has a smooth annular surface. A comb plate is provided having a base portion fixed in close proximity to the pinch nip. The comb plate has finger portions that fit into the recesses, the comb plate configured to prevent the web material from wrapping around the one roller. Also, a bottom deflecting surface can be provided. The bottom deflecting surface fixed in position in close proximity to the pinch nip and having a portion that partially curves around the other roller, the deflecting surface plate configured to prevent the web material from wrapping around the other roller.

According to another aspect of the invention, a web dispensing apparatus is arranged on a slicing machine having a drive roller and a pinch roller with the web material fed therebetween. The drive roller and the pinch roller rotate in opposite directions to drive an extended end portion of the web material through a cutting nip. The lower frame member rotatably mounts one of the drive roller and pinch roller. An upper frame member mounts the other of the drive roller and pinch roller. The lower frame member is pivotally mounted to the upper frame member. The cuffing nip includes a lower edge of the plastic loaf guide mounted to the upper frame member and a plastic cutting edge mounted to the lower frame member. Pivoting the lower frame member away from the upper frame member opens the cutting nip and the space between the drive and pinch rollers to allow the web material to be threaded between the drive and pinch rollers and through the cutting nip.

The drive roller is driven by a servomotor. The servomotor drives the web material in a closely controlled and precise manner. The servomotor can be controlled to interleave a sheet between every cut slice or only interleave sheets between some cut slices but not others, such as between every other cut slice. Alternatively, the servomotor can be controlled to interleave a sheet between every cut slice for a number of slices and then change to interleave sheets less frequently, such as allowing a group of slices to be accumulated without sheets and then interleaving the next group of slices with sheets. The servomotor and associated control allows a great flexibility on the pre-programmed selection of interleaving slices without manual intervention.

According to another aspect of the invention, the web material is dispensed by opposing rollers that not only drive the end portion through the cutting plane but also bend the end portion into a corrugated cross-section. The corrugated cross-section stiffens the web material to project forwardly in cantilever fashion, from the drive rollers without drooping. The corrugated cross-section increases the beam strength of the cantilevered end portion of the web material.

The end portion projects from the corrugated cross-section through the cutting nip and is substantially flattened in the cutting nip. It is advantageous that the corrugation not be present outside the cutting nip to a significant degree if an undulating cut edge of the end portion is not desired.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 19A is a schematic diagram of a spool tension control system of the invention;

FIG. 23A is a sectional view taken generally along line 23A-23A of FIG. 23;

DETAILED DESCRIPTION OF THE PREFERRED EMBODIMENT

Figure 1:
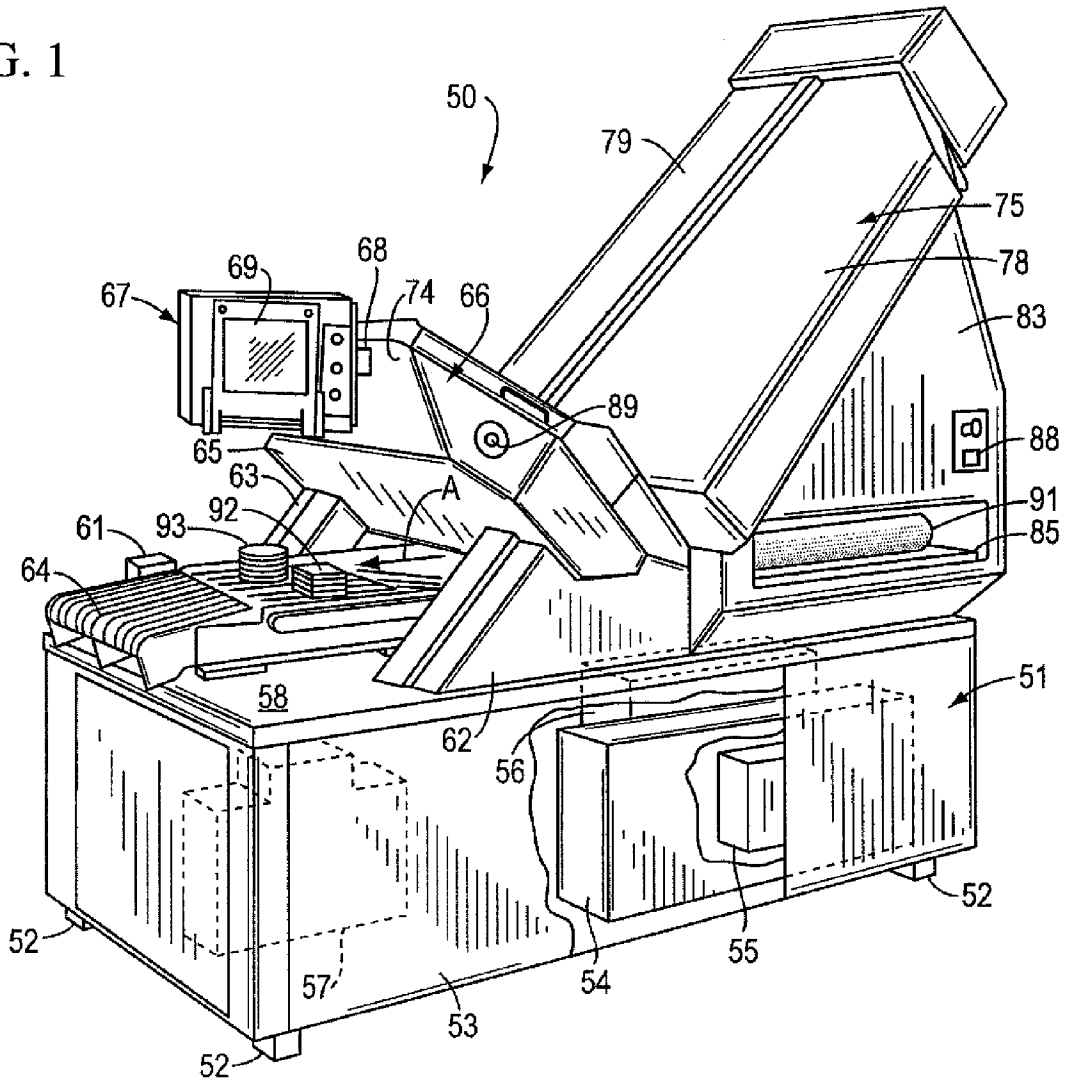
FIG. 1 a perspective view of a high-speed slicing apparatus incorporating the sheet interleaving mechanism of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates one embodiment of a food loaf slicing machine 50 that may incorporate the sheet interleaver of the present invention. The slicing machine can be a high speed slicing machine such as disclosed in U.S. Pat. Nos. 6,484,615; 5,628,237; 5,649,463; 5,704,265; 5,724,874; herein incorporated by reference, or as commercially available as a FX180™, FXPlus™ or SNS® slicing machine and/or system available from Formax, Inc. of Mokena, Ill., USA.

Slicing machine 50 comprises a base 51 that is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale mechanism 57. Base enclosure 53 may also include a pneumatic supply or a hydraulic supply, or both (not shown).

The slicing machine 50 may include a conveyor drive 61 utilized to drive an output conveyor/classifier system 64.

The slicing machine 50 of the illustrated embodiment further includes a computer display touch screen 69 in a cabinet 67 that is pivotally mounted on and supported by a support 68. Support 68 is affixed to and projects outwardly from a member 74 that constitutes a front part of the housing of slicing station 66.

The upper right-hand portion of slicing machine 50, as seen in FIG. 1, comprises a loaf feed mechanism 75 which, in machine 50, includes a manual feed from the right-hand (far) side of the machine and an automated feed from the left-hand (near) side of the machine. Loaf feed mechanism 75 has an enclosure that includes a far-side manual loaf loading door 79 and a near-side automatic loaf loading door 78.

Figure 2:
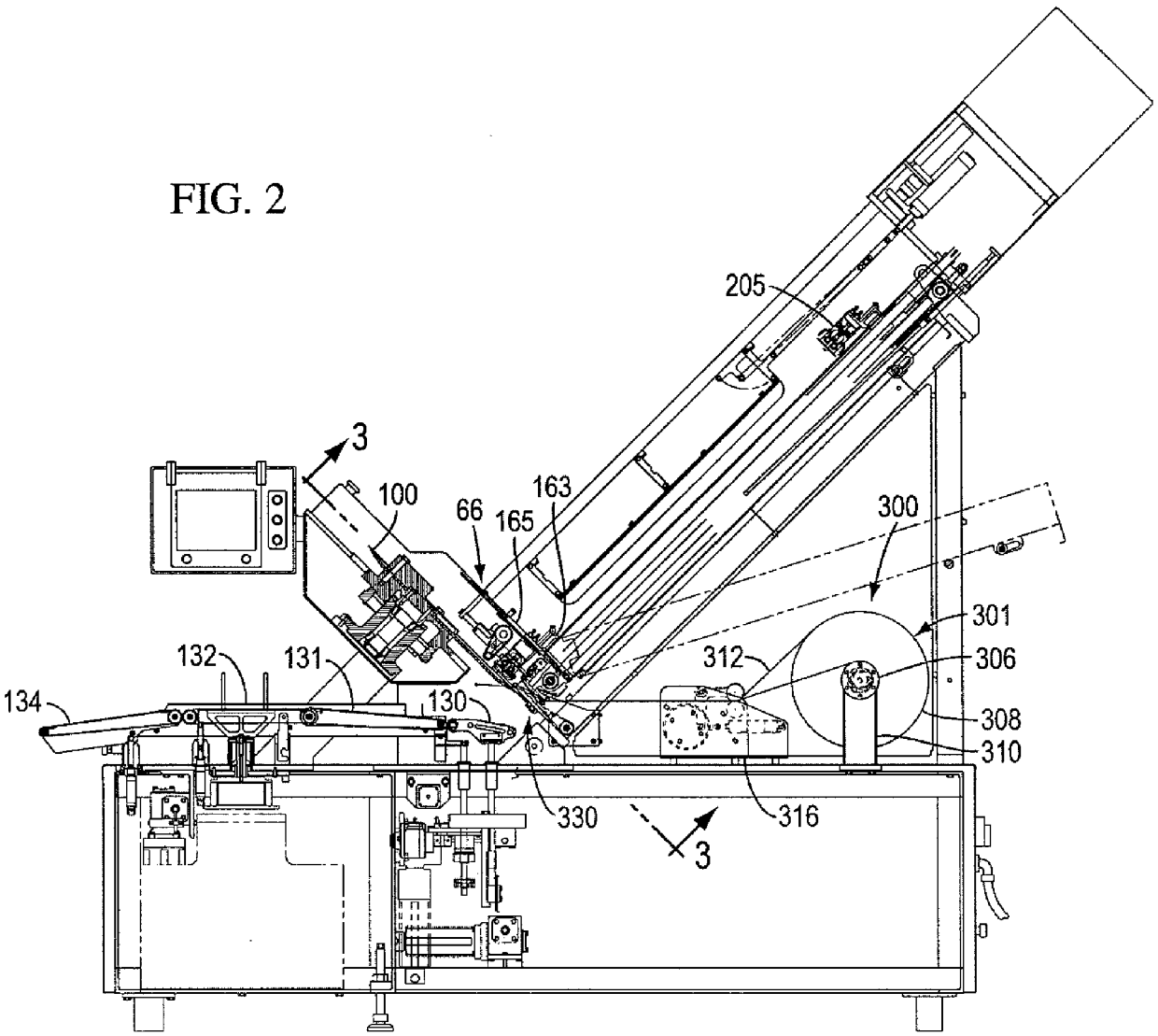
FIG. 2 is a diagrammatic sectional view of the slicing apparatus of FIG. 1.

Referring first to conveyor/classifier system 64 at the left-hand (output) end of slicing machine 50 as illustrated in FIG. 2, it is seen that system 64 includes an inner stacking or receiving conveyor 130 located immediately below slicing station 66. Conveyor 130 is sometimes called a "jump" conveyor. From conveyor 130 groups of food loaf slices, stacked or shingled, are transferred to a decelerating conveyor 131 and then to a weighing or scale conveyor 132. From the scale conveyor 132 groups of food loaf slices move on to an outer classifier conveyor 134. On the far side of slicing machine 50 the sequence is substantially the same.

Slicing machine 50 may further include a vertically movable stacking grid comprising a plurality of stack members joined together and interleaved one-for-one with the moving elements of the inner stack/receive conveyor 130. Stacking grid can be lowered and raised by a stack lift mechanism. Alternatively, food loaf slices may be grouped in shingled or in stacked relationship directly on the receive/stack conveyor 130, with a series of stacking pins replacing the grid. When this alternative is employed, lift mechanism is preferably connected directly to and is used for vertical positioning of conveyor 130.

Loaf feeding mechanism 75 preferably includes a back-clamp 205 respectively associated with each food loaf. The back-clamps 205 secure the rear portion of each loaf and assist in advancing each loaf at individually determined rates into the slicing station 66. The loaf feeding mechanism 75 also preferably comprises a system of short conveyors for advancing food loaves from loaf feed mechanism 75 into slicing station. FIG. 2 shows a short lower loaf feed conveyor 163. The short lower conveyor 163 is located immediately below a short upper feed conveyor 165. A loaf cutting guide 166 (FIG. 3) is disposed adjacent the conveyors 163, 165 with a recess 167 for guiding the loaf to the blade.

The slicing machine 50 of FIG. 1 is shown in a state ready for operation. There is a food loaf 91 on tray 85; waiting to be loaded into loaf feed mechanism 75 on the near-side of machine 50. Machine 50 produces a series of stacks 92 of food loaf slices that are fed outwardly of the machine, in the direction of the arrow A, by conveyor classifier system 64. Machine 50 also produces a series of stacks 93 of food loaf slices that move outwardly of the machine on its output conveyor system 64 in the direction of arrow A.

The loaf feed mechanism 75 drives the loaves into the slicing station where they are sliced by a rotating knife blade 100 (FIG. 2) that is disposed at the output portions of the short conveyors. The thickness and total weight of the slices are controlled by computer 54 which actuates various mechanical components associated with the slicing operation. The slice thickness and total weight for each sliced group are programmed through the touch screen 67 which interfaces with computer 54. As the blade slices the loaves, the slices are deposited on receiving conveyor 130 where the proper numbers of slices are either stacked or shingled. The receiving conveyor 130 then drives the groups from the slicing station for subsequent classifying and packaging.

The drive motor for the blade in slicing station 66 is preferably a D.C. variable speed servo motor mounted in the machine base 51. The receiver lift mechanism is driven by a stacker lift motor, again preferably a variable speed D.C. servo motor. The loaf feed drive mechanism comprising the back-clamp 205 and the short loaf feed conveyors 163 and 165 is driven by a servo motor.

FIG. 2 illustrates the sheet interleave apparatus 300 of the present invention. For purposes of description, a single sheet interleaving apparatus is described for a slicing machine set up for slicing only one loaf. It should be understood that for a slicing machine that slices two or more side-by-side loaves, multiple sheet interleaving apparatuses 300 can be provided in a corresponding side-by-side arrangement.

The apparatus 300 includes a web material supply 301 such as a spool 306 for dispensing web material 312 from a roll 308. The spool 306 is supported on a column 310 that allows the roll 308 to revolve to dispense web material 312. The web material 312 extends from the roll 308 and is threaded through a web material drawing station such as an unwind station 316. The web material extends from the unwind station 316 into a feed station 330. The unwind station 316 is described in detail below.

Figure 8:
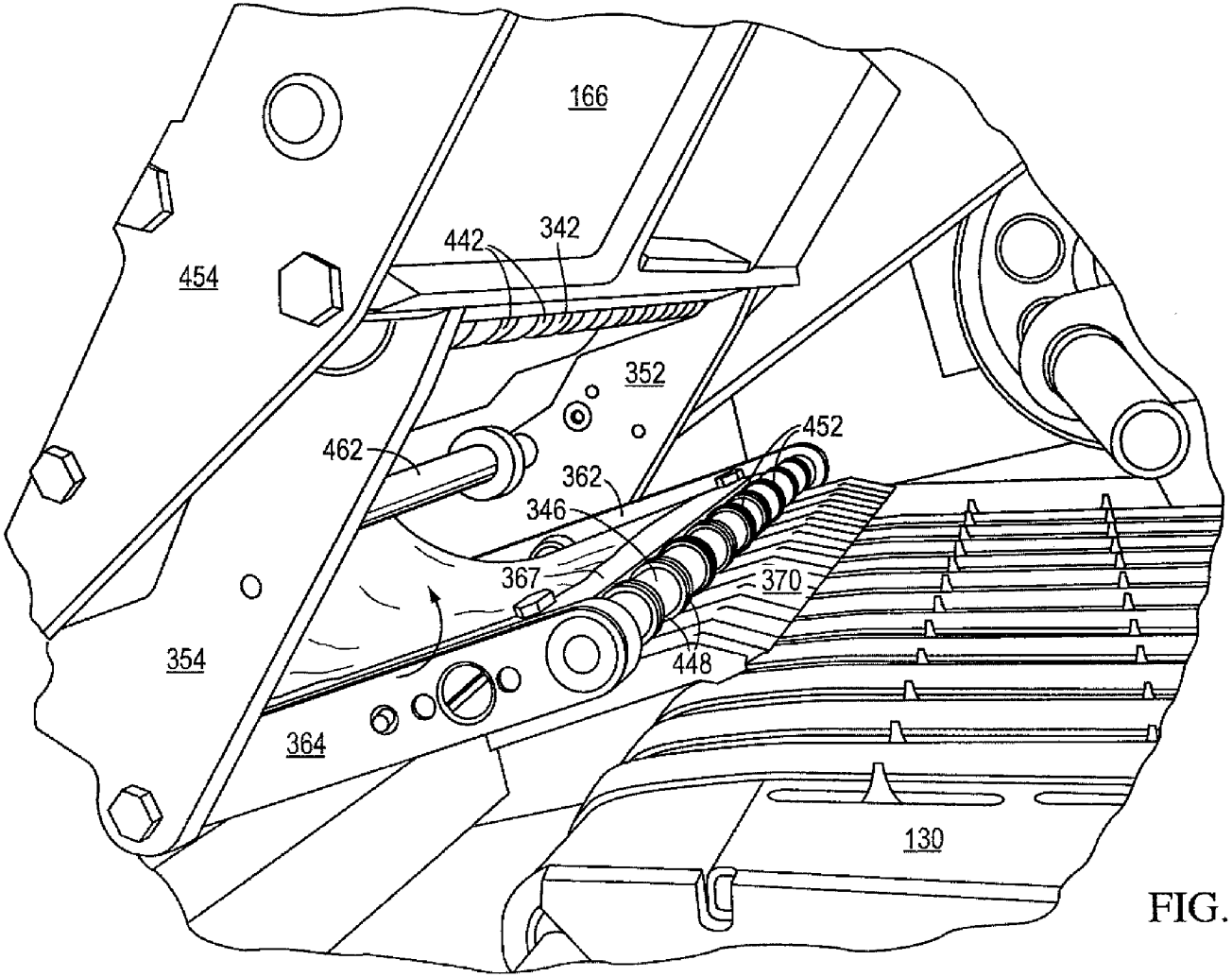
FIG. 8 is a fragmentary perspective view of the interleaving mechanism of FIG. 7 shown in an open, refill condition.
Figure 9:
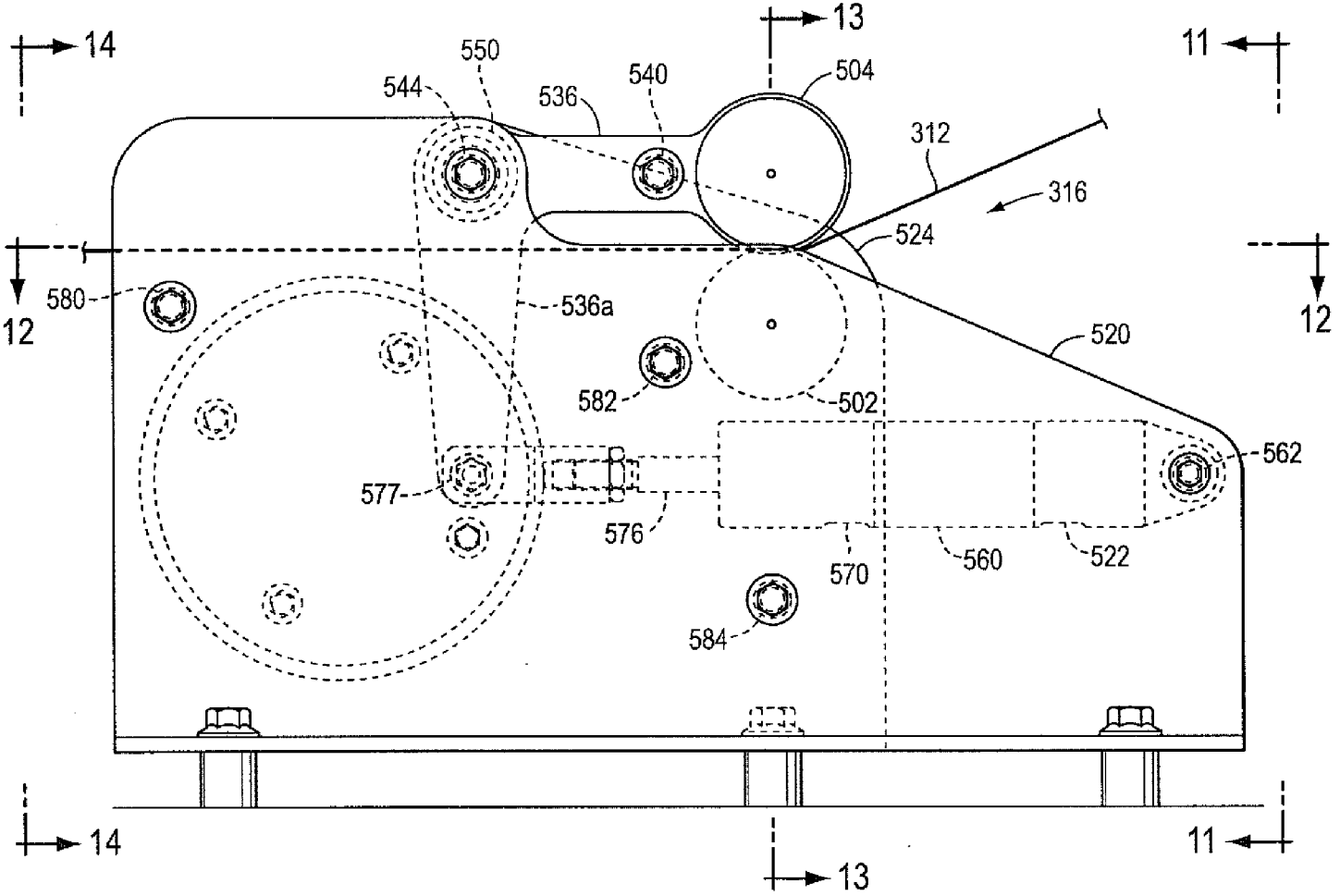
FIG. 9 is a fragmentary, enlarged elevational view of a portion of the interleaving mechanism shown in FIG. 2.
Figure 10:
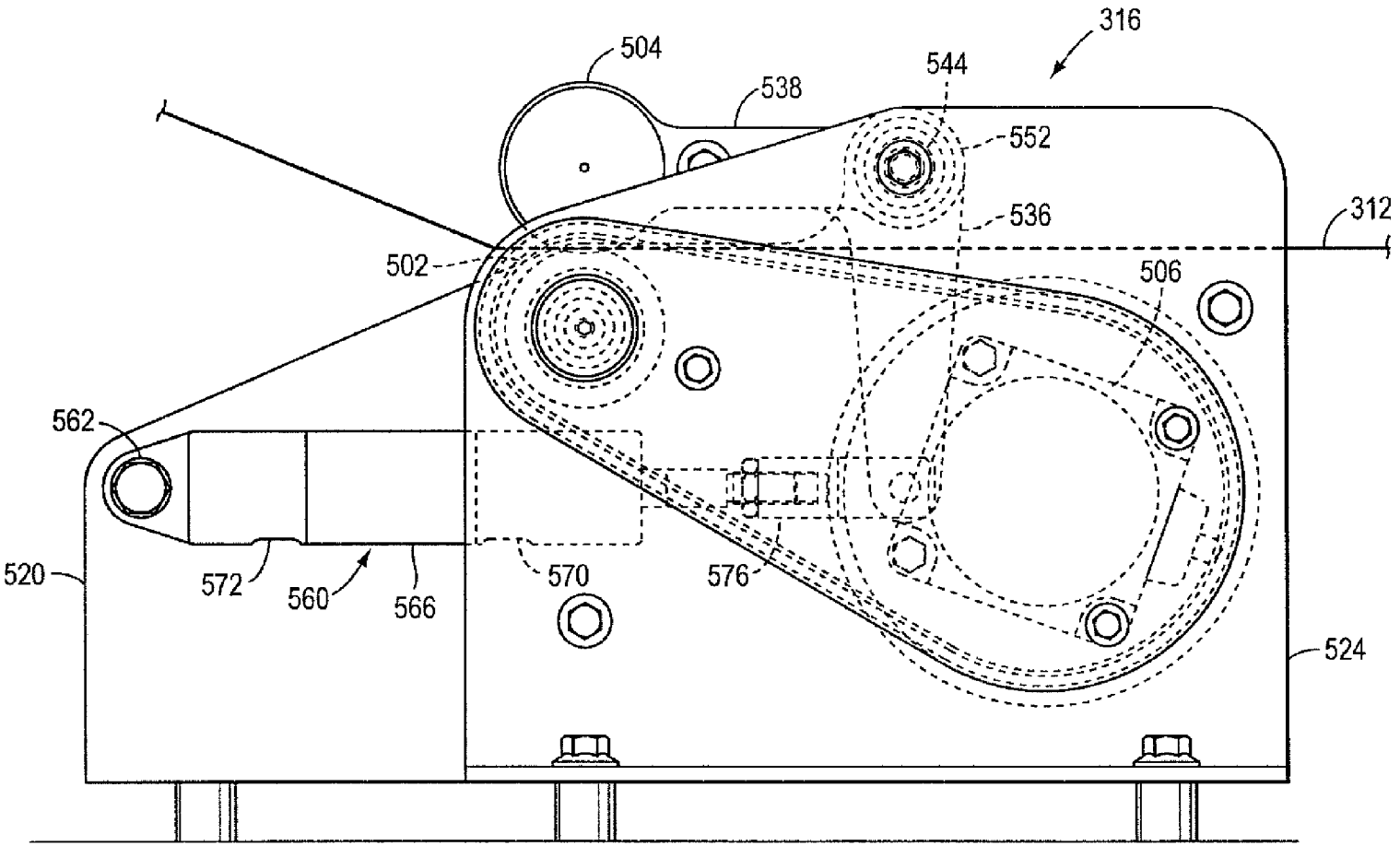
FIG. 10 is a rear elevational view of the portion shown in FIG. 9.

FIGS. 3-8 illustrate the feed station 330 in more detail. The feed station 330 includes an idle roller 336 that deflects the web material 312 upwardly to be threaded through a roller drive that comprises a drive roller 342 and an opposing pinch roller 346. The drive roller 342 is rotatably mounted at a first end thereof to a first support plate 352 and at a second end to a second support plate 354. The support plates 352, 354 are fixedly attached to the framework of the slicing machine. The support plate 352 extends downward to form a motor support portion 355 that mounts a servomotor or stepper motor 360. The pinch roller 346 is rotatably mounted at a first end thereof to a first inside support plate 362 and at a second end to a second inside support plate 364. The inside support plates 362, 364 are spaced apart by a pinch roller axle 366, a bridge plate 367 and a strut 368. The strut 368 also acts as a pivot for the inside support plates 362, 364. The inside support plates 362, 364 can be pivoted on the strut 368 to swing the pinch roller 346 from a working position (FIG. 7) to an open, web material refill or maintenance position (FIG. 8). A plastic cutting guide 370 is mounted to the bridge plate 367 beneath the pinch roller 346 and extends in an angular upward direction, when in the working position, from the inside support plates 362, 364. The plastic cutting guide 370 forms a cutting nip with the loaf guide 166.

Figure 3:
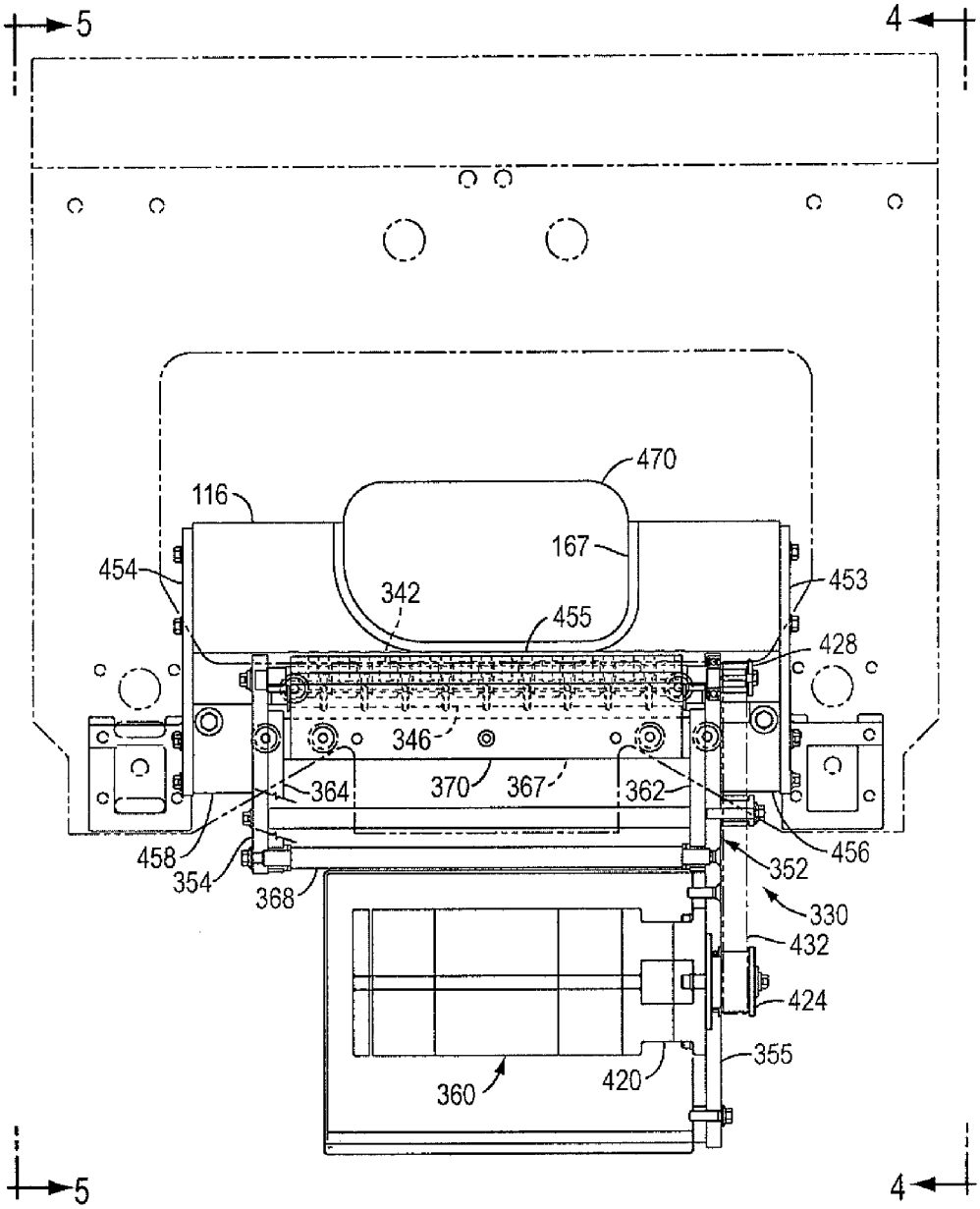
FIG. 3 is a fragmentary sectional view taken generally along line 3-3 of FIG. 2.
Figure 4:
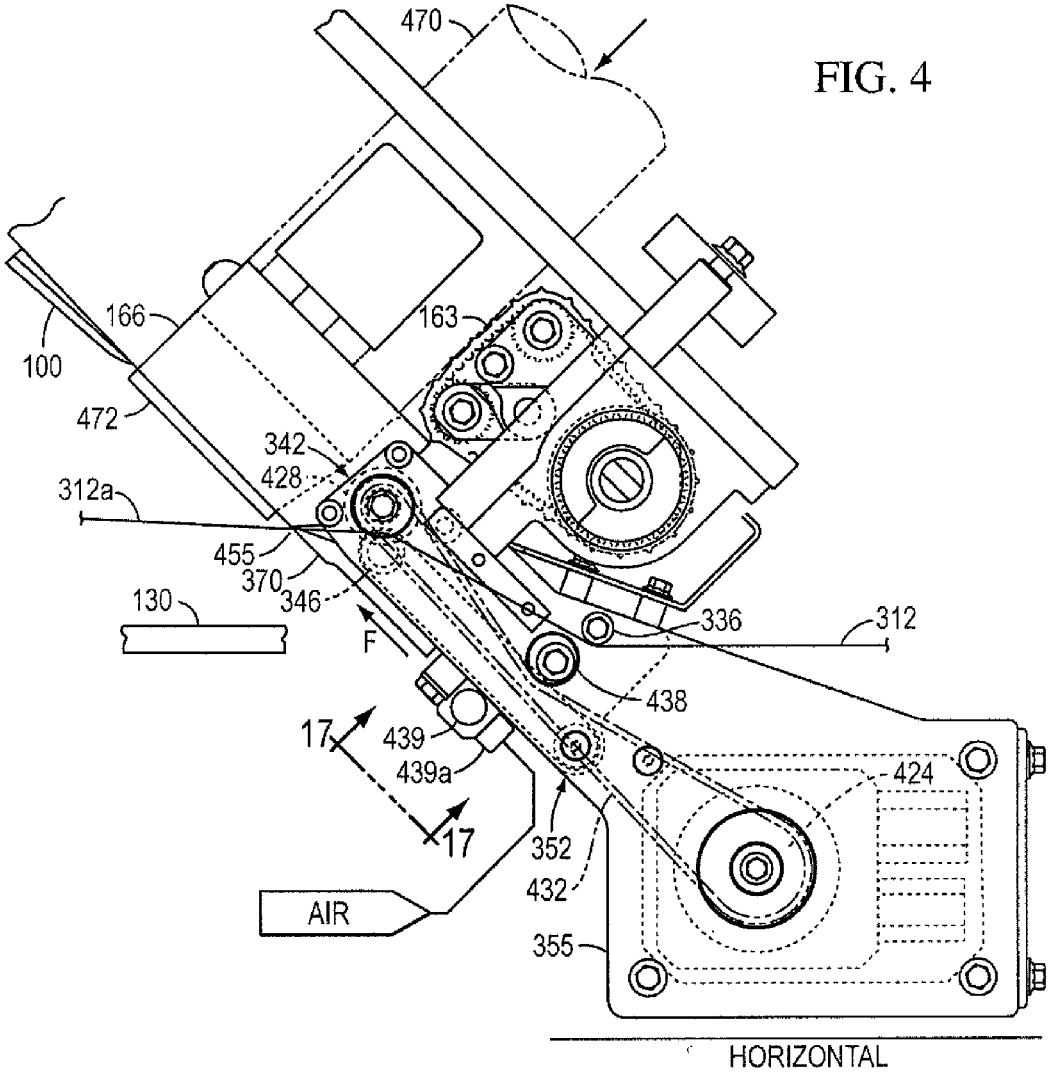
FIG. 4 is a fragmentary side view taken along line 4-4 of FIG. 3.
Figure 5:
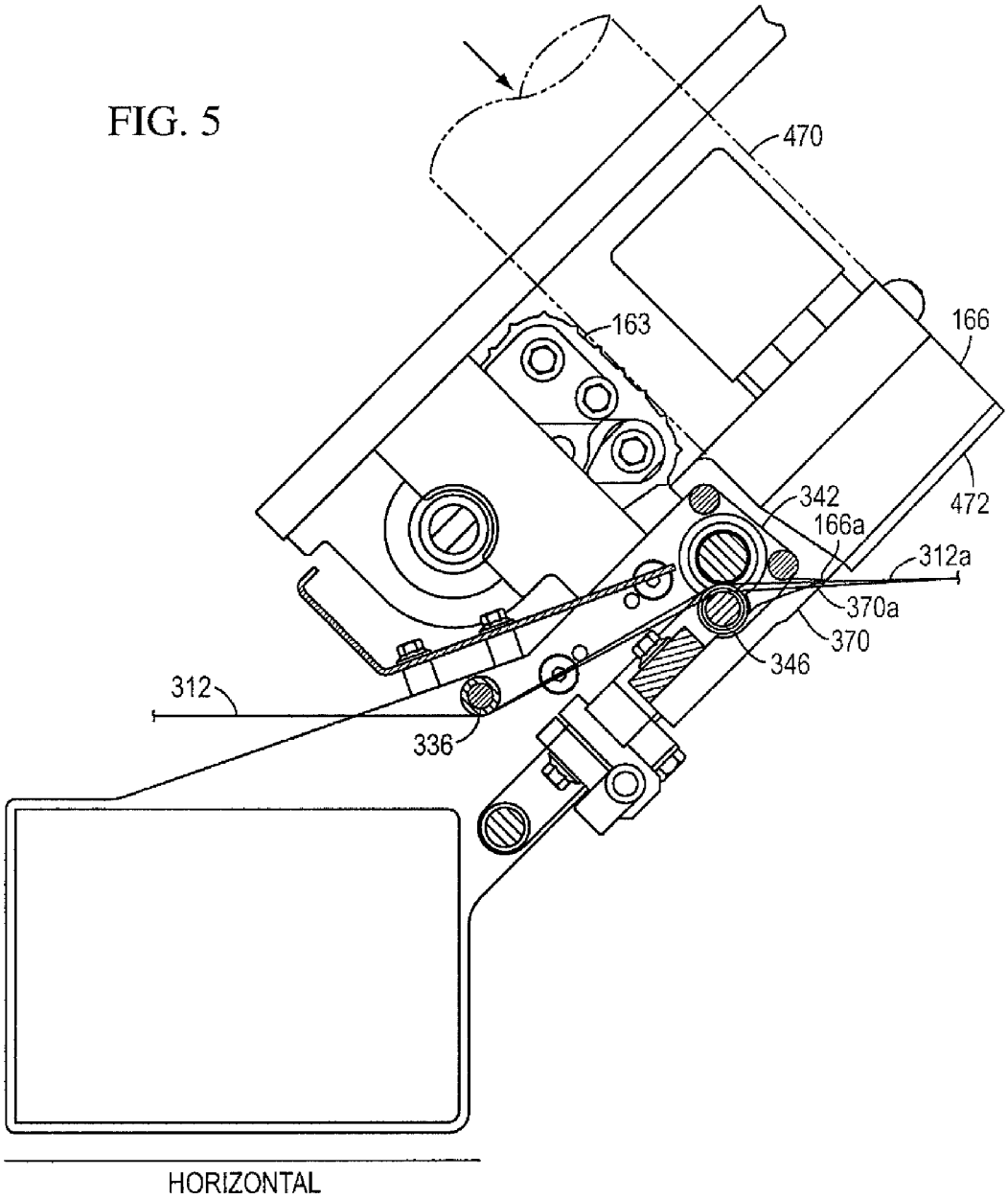
FIG. 5 is a fragmentary side view taken along line 5-5 of FIG. 3.

The servo motor 360 includes a housing 420 that is fastened to the motor support portion 355. A motor output shaft is coupled to a drive pulley 424 (FIGS. 3 and 4). The drive roller 342 includes a driven pulley 428. A drive belt 432 is wrapped around the pulleys 424, 428. Thus the motor 360 when energized drives the drive roller to rotate. A belt tensioner 438 presses an outside surface of the belt 432 to maintain a proper tension of the belt on the pulleys.

Figure 17:
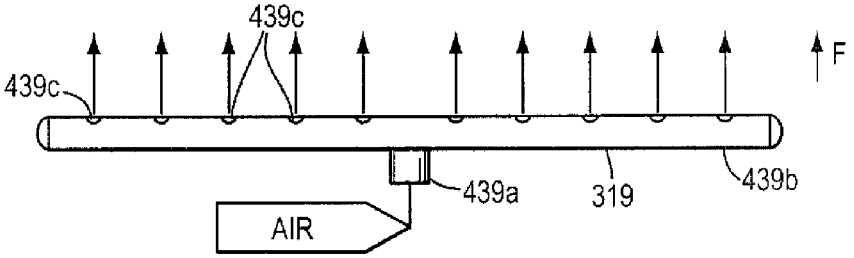
FIG. 17 is a schematic, fragmentary sectional view taken generally along line 17-17 of FIG. 4.

FIGS. 4 and 17 illustrate a pressurized air manifold 439 that direct a plurality of air streams in the direction F toward the blade 100. The manifold includes a tubular body 439*b* with an air inlet 439*a*. The tubular body is closed at opposite ends and includes a series of orifice outlets 439*c*, such as ten, which direct the air in the direction F.

Figure 6:
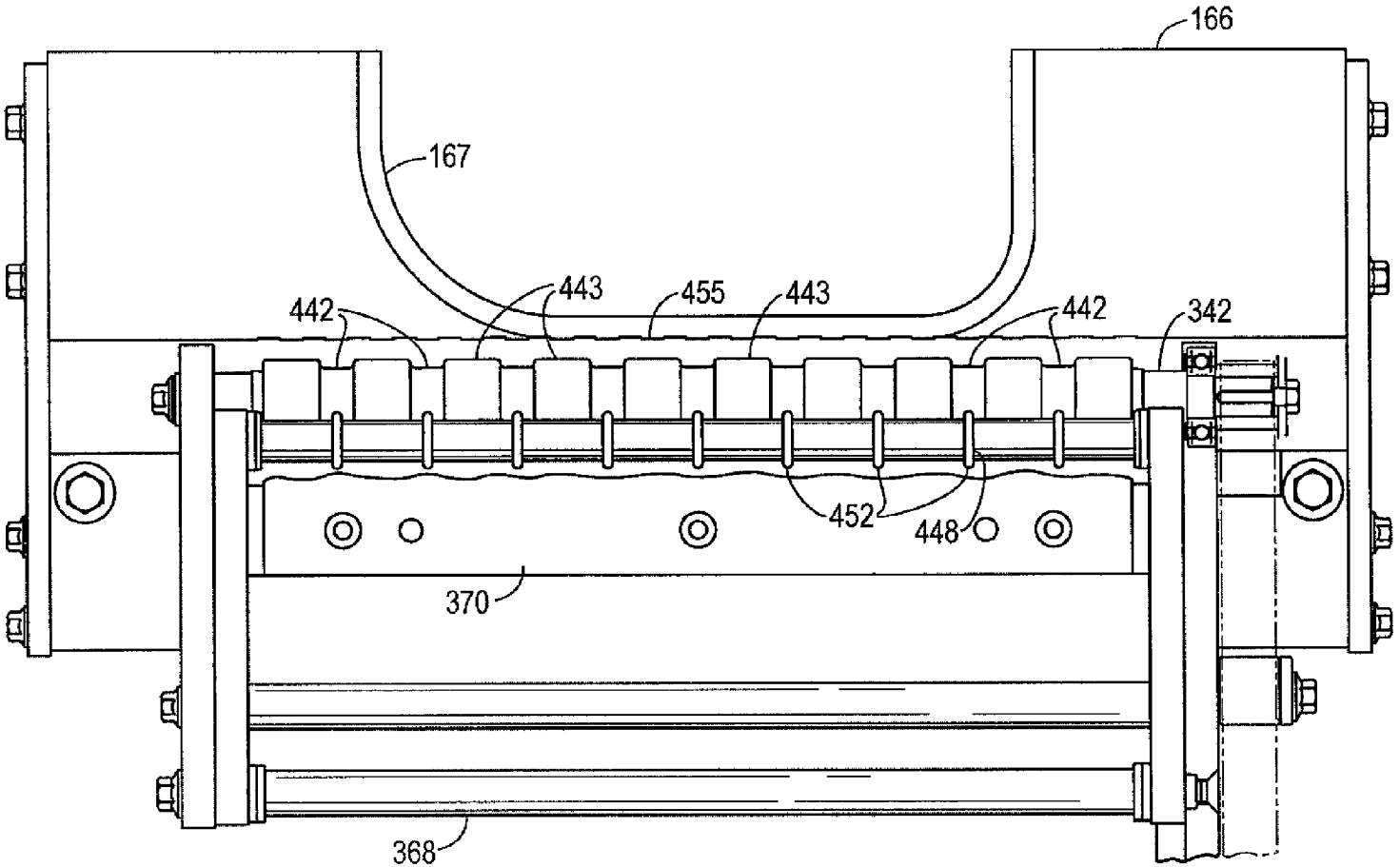
FIG. 6 is a fragmentary, enlarged view taken from figure three.
Figure 7:
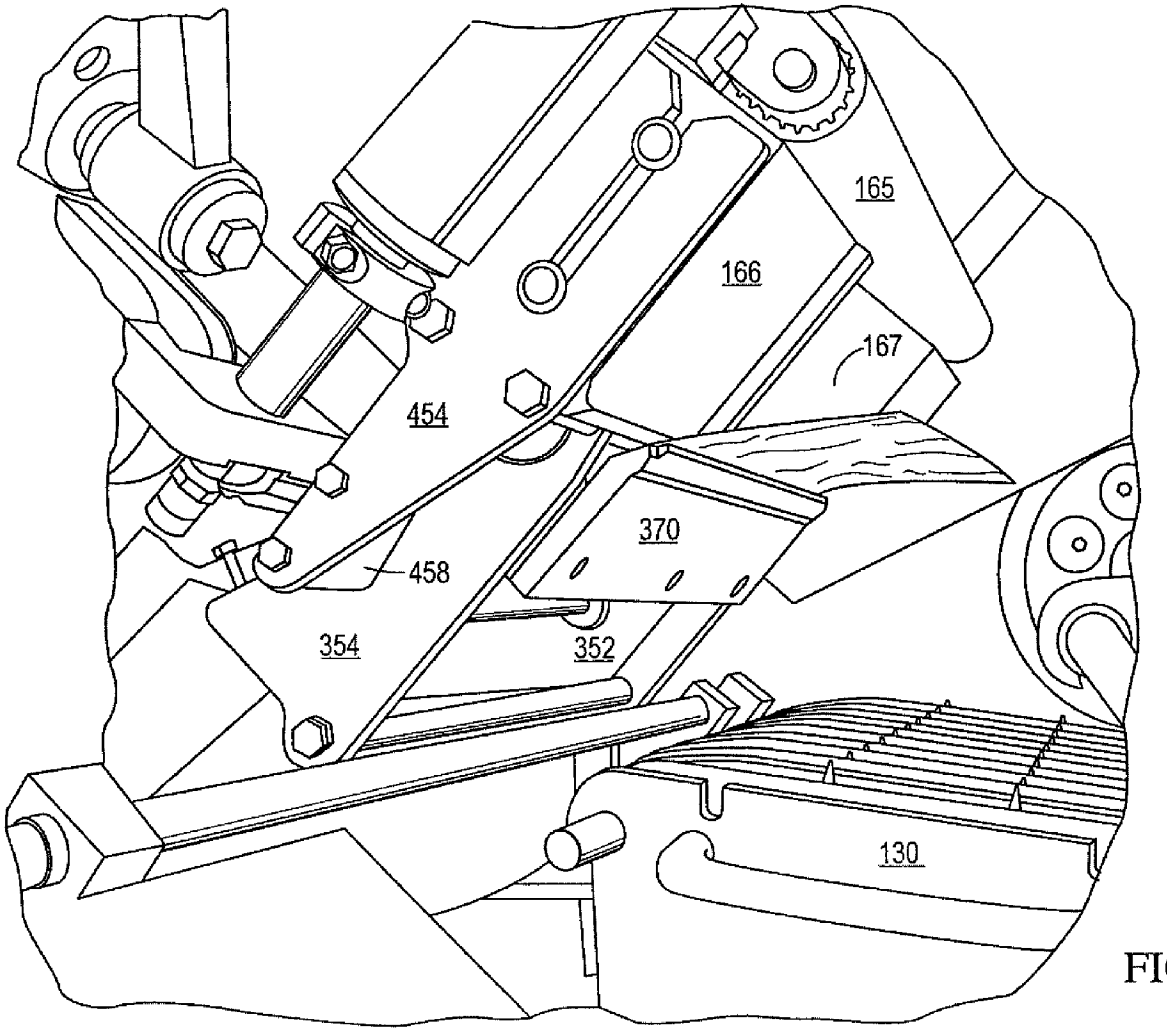
FIG. 7 is a fragmentary perspective view of the interleaving mechanism of FIG. 2 shown in an operating condition.

As illustrated in FIG. 6, the drive roller 342 includes a plurality of circumferential grooves or annular recesses 442 spaced apart by rings 443 along a length of the drive roller 342. The pinch roller includes a plurality of circumferential shoulders or rings 448 that correspond in axial position to the grooves 442. On a select group of the shoulders 448, rubber drive rings 452 are applied, tightly gripping the outside surface of the respective shoulders 448. When the inside support plates 362, 364 are swung upward into working position, the shoulders 448 nest into the grooves 442. The rubber drive rings 452 approach the radial bottom of the grooves to a close tolerance corresponding to a thickness of the web material 312.

The web material 312 is pinched and bent to be forced into the grooves 442 and over and around the drive rings 452. The web material 312 is bent into a corrugated shape in the region of the grooves 442. This corrugated shape flattens out along a length of an extended end portion 312*a* in a forward direction as the extended end portion 312*a* exits a cutting nip 455 formed between a top edge 370*a* of the cutting guide 370 and a bottom edge 166*a* of the loaf guide 166 but is present sufficiently to provide an increased bending moment of inertia or beam strength to the extended end portion 312*a* that extends unsupported from the cutting nip 455. This additional beam strength prevents the extended end portion 312*a* from drooping before the cut slice falls with the sheet cut from the extended end portion 312*a* onto the conveyor or onto a previously cut slice.

The support plates 352, 354 are fixedly attached to machine brackets 453, 454 respectively via plastic spacers 456, 458 and an axle of the idle roller 336 between the plates 352, 354. The guide 166 is also fastened to and between the machine brackets 452, 454.

In operation, the web material 312 is driven forwardly by the drive roller 342 to a position where the extended end portion 312*a* of the web material having a length approximately equal to a height of the sliced product loaf or slab 470. The air from the orifices 439*c* of the manifold 439 assist in holding the extended end portion 312*a* adjacent to the end of the loaf. The blade 100 slices through both the loaf 470 and the extended end portion 312*a* and a sheet formed of the extended end portion 312*a* and a slice 472 fall together onto the conveyor 130, the sheet underlying the slice. The process is repeated for the next slice resulting in an interleaved stacking of sheets and slices.

Figure 11:
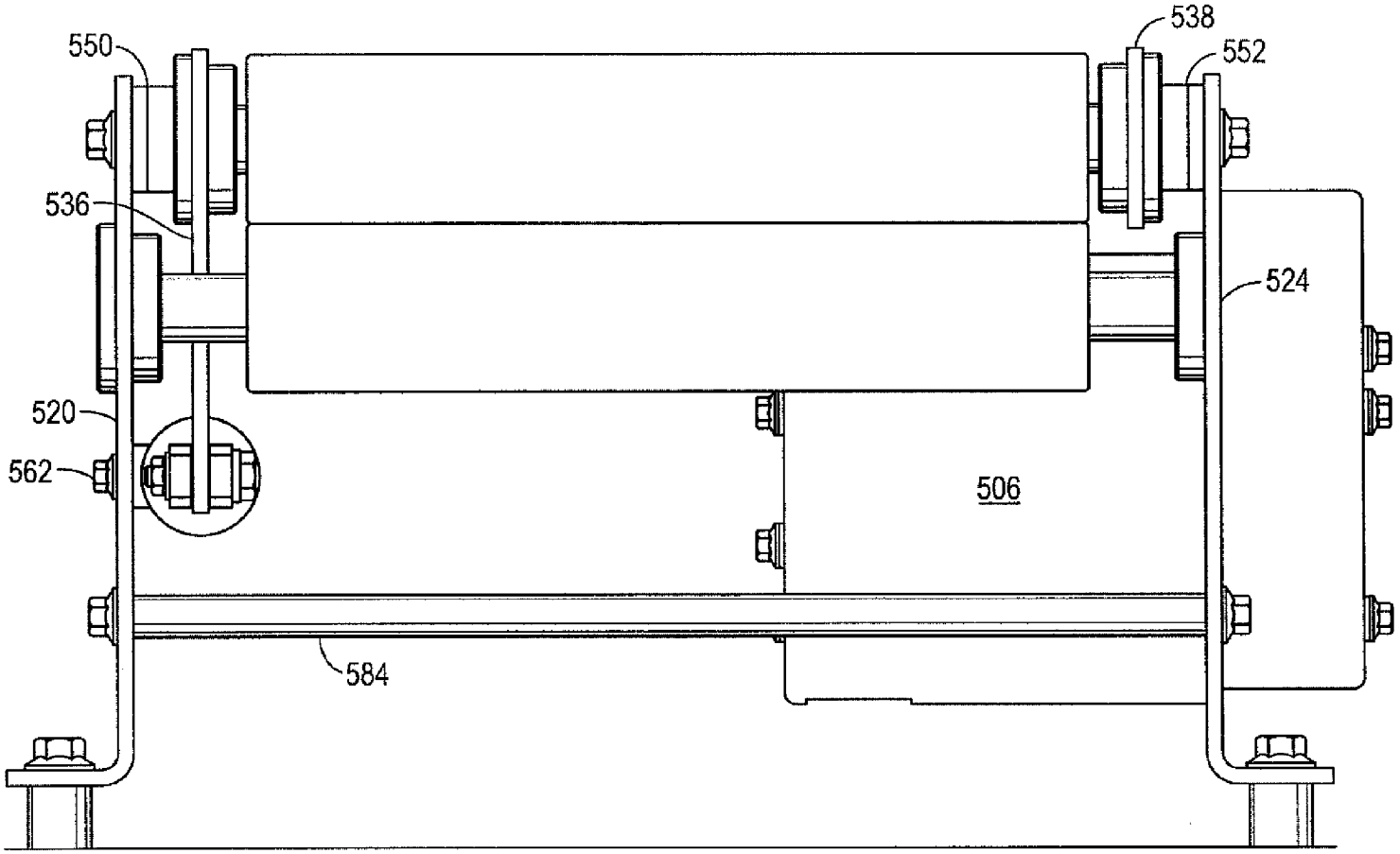
FIG. 11 is a right side view of the portion shown in FIG. 9 taken generally along line 11-11 of FIG. 9.
Figure 12:
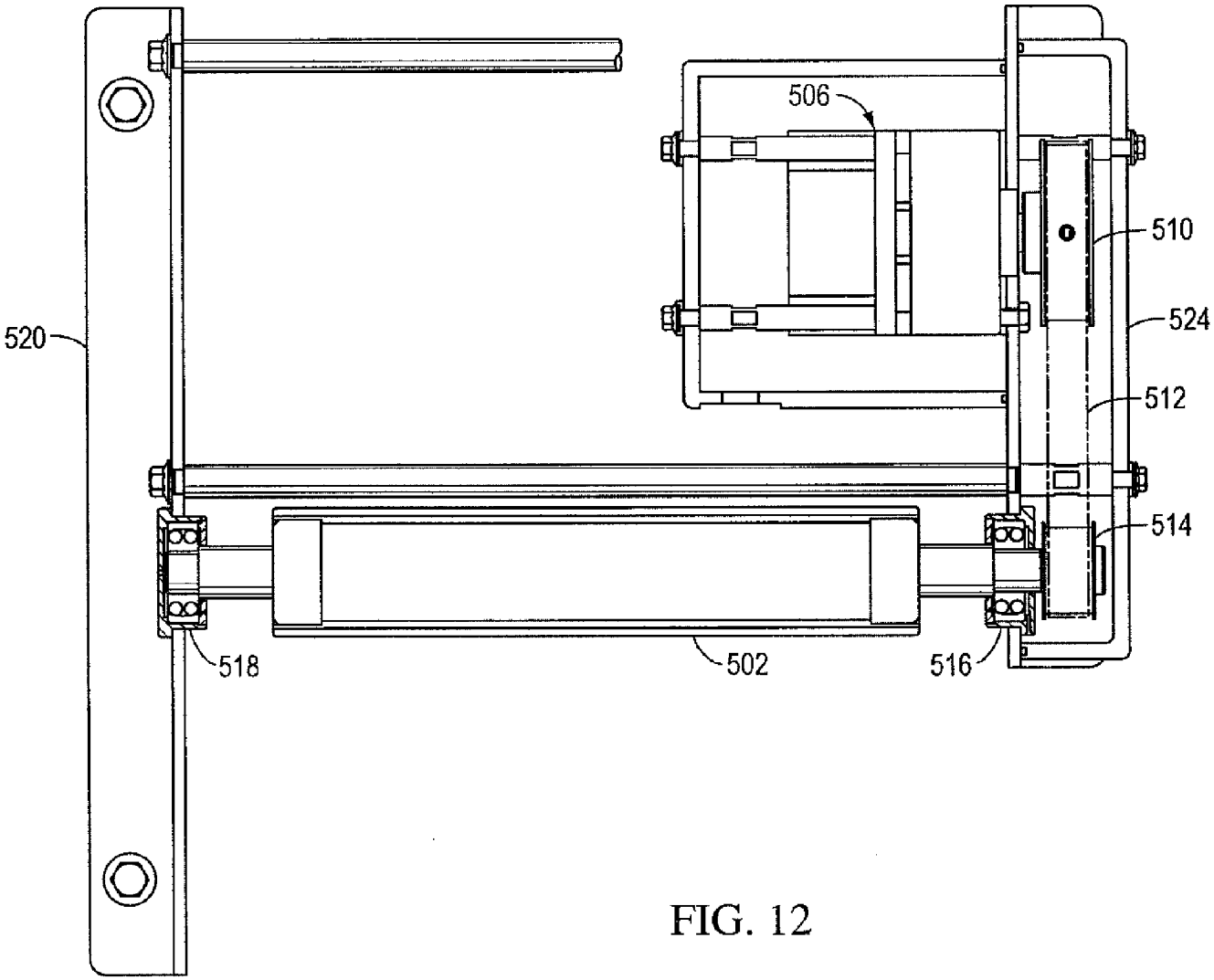
FIG. 12 is a sectional view taken generally along line 12-12 of FIG. 9.

FIGS. 9-15 illustrate the unwind station 316 for unwinding web material 312 from the roll 308. The web material 312 is pinched between a drive roller 502 and a pinch roller 504. The drive roller 502 is driven by a servomotor or stepper motor 506. The servomotor 506 has an output shaft that rotates a drive pulley 510 that circulates a belt 512 that rotates a driven pulley 514 connected to the drive roller 502 (FIG. 12). The drive roller 502 is mounted by bearings 516, 518 between a front sidewall 520 and a rear sidewall 524. The servomotor 506 is also mounted to the rear sidewall 524. The sidewalls 520, 524 are fastened to a top base of the machine cabinetry.

The pinch roller 504 is mounted by bearings 530, 532 (FIG. 13) to a front L-shaped lever 536 and a rear plate 538. The lever 536 and the rear plate 538 are arranged substantially in parallel and connected to each other by a first strut 540 and a second strut 544. The second strut 544 also rotationally connects the lever 536 and a rear plate 538 to the sidewalls 520, 524 via bearings 550, 552 (FIG. 11).

A pneumatic cylinder 560 is pivotally fastened to the front sidewall 520 by a fastener 562. The pneumatic cylinder 560 includes a cylinder body 566 that has pressurized air inlet/outlets 570, 572 wherein pressurized air is selectively communicated to/from these inlets/outlets to move a piston (not shown) that acts on a actuator rod 576 extending from the cylinder body 566. The actuator rod 576 is pivotally connected to a substantially vertical leg 536*a* of the L-shaped lever 536 at a pivot connection 577. Pressurized air within the cylinder 560 can exert an extending force on the actuator rod 576 that will urge the lever 536 clockwise (FIG. 9) about the strut 544 to cause in the pinch roller 504 to exert a clamping force on the web material 312 against the drive roller 502. Given typical surrounding parameters, the pressure can be about 30 psig. The drive roller 502 includes an outer sleeve 502*a* and the pinch roller 504 includes an outer sleeve 504*a*, wherein the outer sleeves 502*a*, 504*a* are composed of a gripping material to effectively, frictionally, transport the web material 312 that is pinched therebetween.

The front wall 520 and the rear wall 524 are further braced by a plurality of struts 580, 582, 584.

Figure 13:
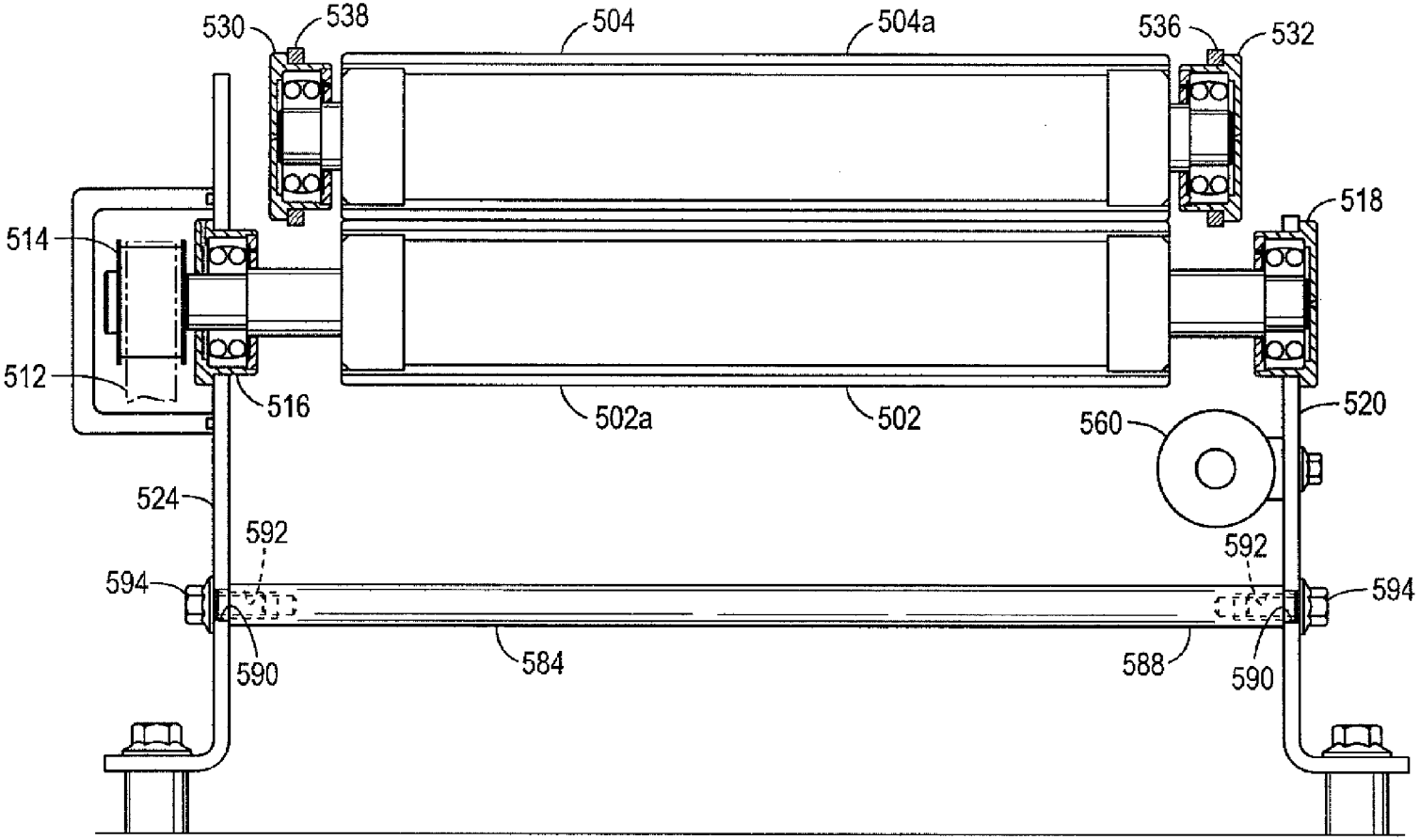
FIG. 13 is a sectional view taken generally along line 13-13 of FIG. 9.
Figure 14:
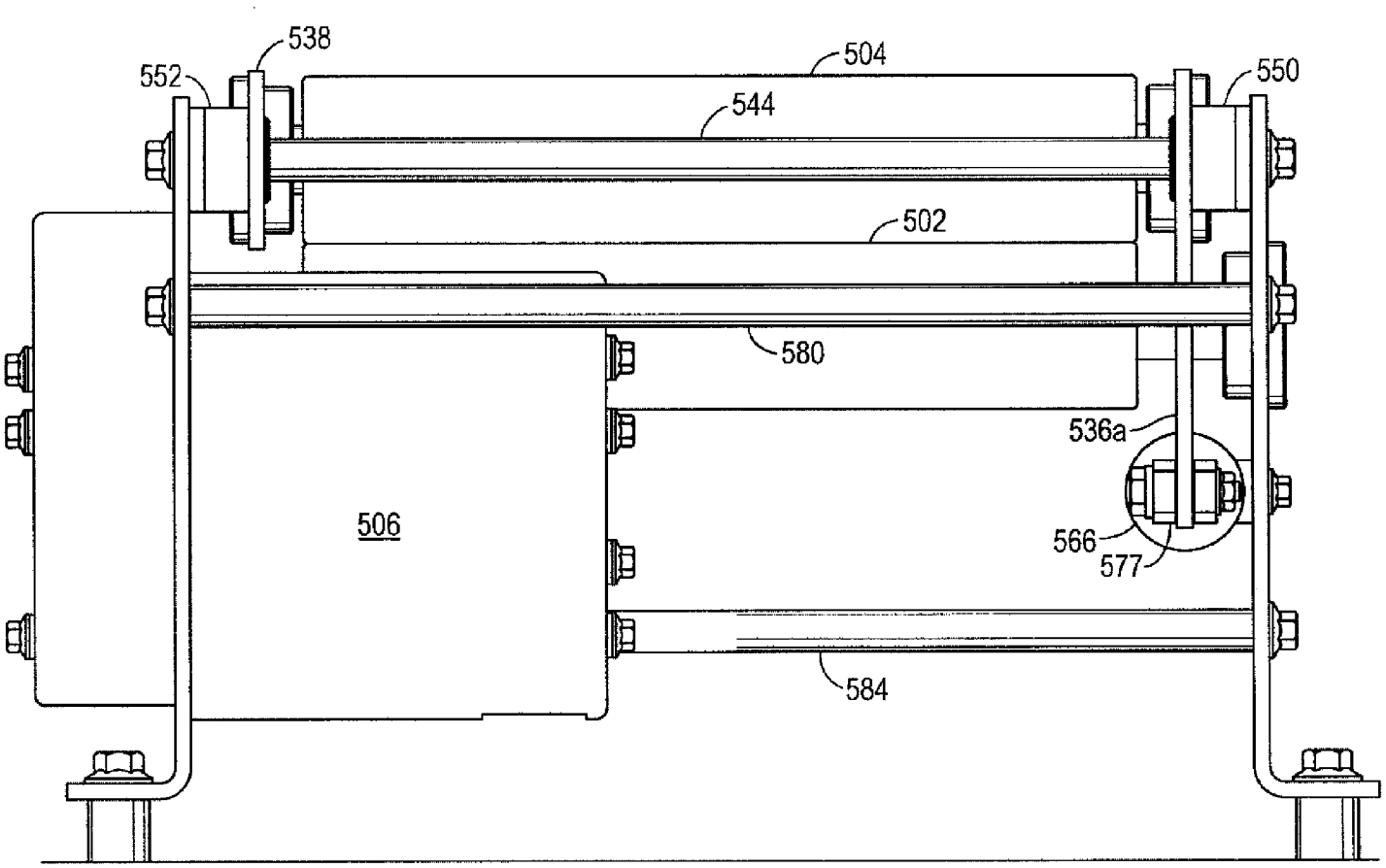
FIG. 14 is a left side view of the portion shown in FIG. 9 taken generally along line 14-14 of FIG. 9.
Figure 15:
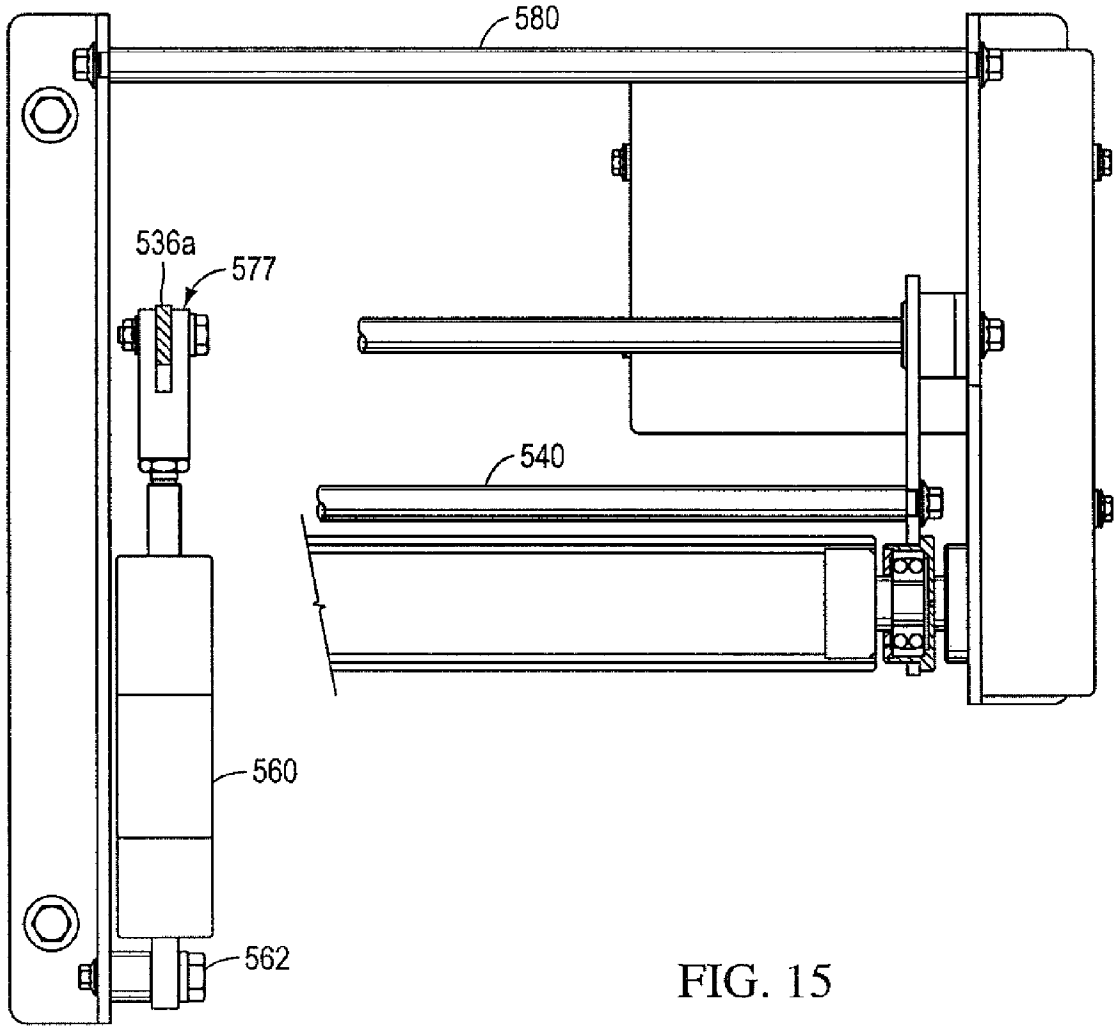
FIG. 15 is a fragmentary sectional view taken generally along line 12-12 of FIG. 9 with portions removed for clarity.

A typical configuration of a strut and strut connection of the station 316 is shown in FIG. 13, demonstrated by the strut 584. A typical strut includes a tubular body 588 that has an outside diameter greater than a hole 590 formed in each of the sidewalls 520, 524. The tubular body 588 includes tapped end holes 592. Fasteners 594 insert through the holes 590 and are threaded tightly into the end holes 592. The tubular body 588 is thus clamped tightly to an inside surface of the sidewalls 520, 524.

In operation, the servomotor 506 is a motor sized to unwind the roll 308 at a sufficient speed, such as a 20-500 RPM, 7.9 lb-in. motor. The servomotor 360 is sized to deliver the extended end portion 312*a* at a rapid rate for the succession of slices.

Figure 16:
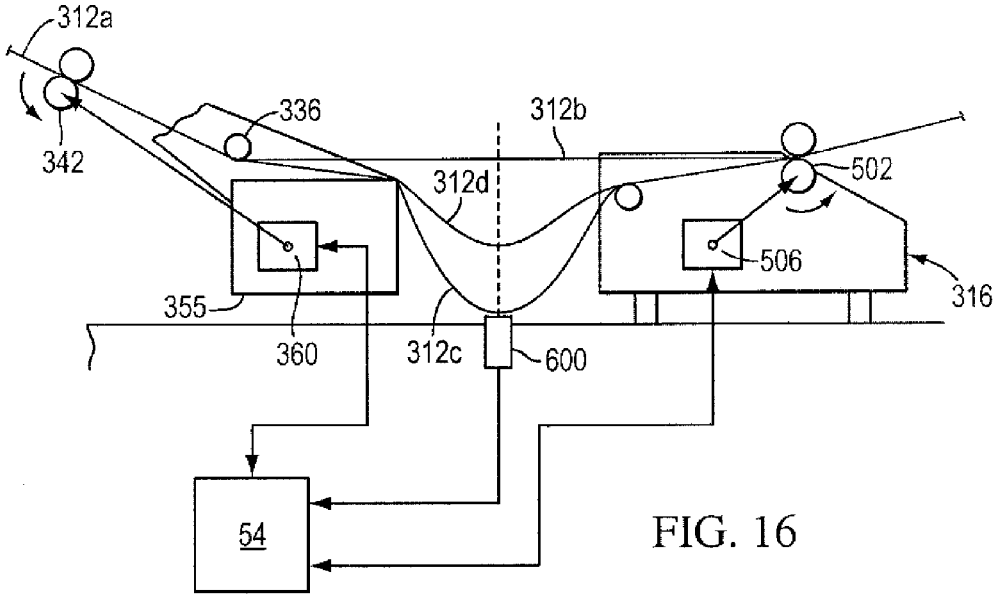
FIG. 16 is a schematic control diagram.

FIG. 16 illustrates in schematic form three degrees of slackness of the web material 312, shown represented by the line or curves 312*b*, 312*c* and 312*d*. Without a sufficient slackness in the web material 312 upstream of the roller 342, the delivery of the extended end portion 312*a* can be hampered during high speed operation. Additionally, too much slackness can hamper the delivery of the extended end portion 312*a*. The line 312*b* representing zero accumulation, and the parabola 312*c* representing maximum accumulation, represent the desired limits of operation. The intermediate parabola 312*d* represents a preferred operating condition.

A sensor 600 is used to sense the slackness, or accumulation, of the web material 312 between the rollers 342 and 502. The sensor can be an ultrasonic sensor, an optical sensor, such as a laser or photoeye, or other type of sensor. The sensor 600 can project an ultrasonic or optical beam signal upwardly. The sensor 600 communicates the web material lowest position, for example the lowest positions on the line or curves 312*b*, 312*c* or 312*d* with the machine control or computer 54 which is in signal-communication with the servomotors 360, 506. If the slackness approaches the condition 312*b*, the motor 506 can be increased in speed to unwind material at a greater rate.

If the slackness condition approaches condition 312*c* the motor 506 can be slowed. The speed of the motor 360 could also be adjusted in coordination with the slicing speed, if desired, to adjust the slackness.

Figure 18:
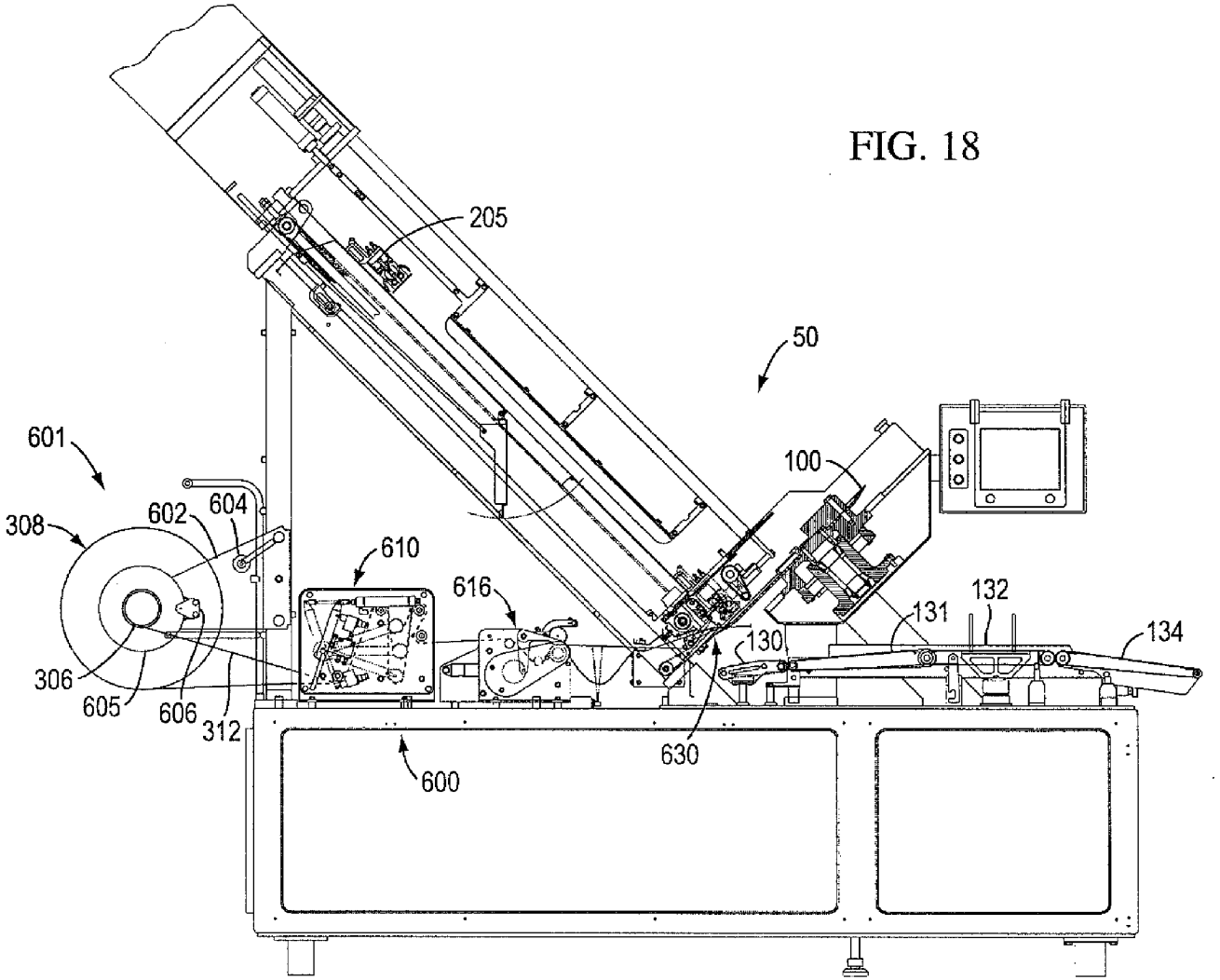
FIG. 18 is a diagrammatic sectional view of the slicing apparatus of FIG. 1 incorporating an alternate embodiment sheet interleaving mechanism of the invention.

FIG. 18 illustrates an alternate embodiment sheet interleave apparatus 600 of the present invention. This embodiment is identical to the sheet interleave apparatus 300 except as noted. Identical reference numbers indicate like components.

The apparatus 600 includes a modified web material supply 601 that includes the spool 306 for dispensing web material 312 from a roll 308. The spool 306 is supported on a bracket 602 that allows the roll 308 to revolve to dispense web material 312. A non-contact sensor 604, such as an ultrasonic or optical sensor senses the diameter of the roll 308 and communicates to machine control or to an alarm when the roll is depleted.

The spool 306 is fixed to a disc 605 to rotate therewith. A disc brake assembly 606 is fixed to the bracket 602 and is selectively engageable to the disc 605 to stop the disc 605 and spool 306 from rotating as described below.

The web material 312 extends from the roll 308 and is threaded through a tension control station 610 and then to a draw station such as an unwind station 616. The web material 312 extends from the unwind station 616 into a feed station 630. The unwind station 616 is described in detail below.

Figure 19:
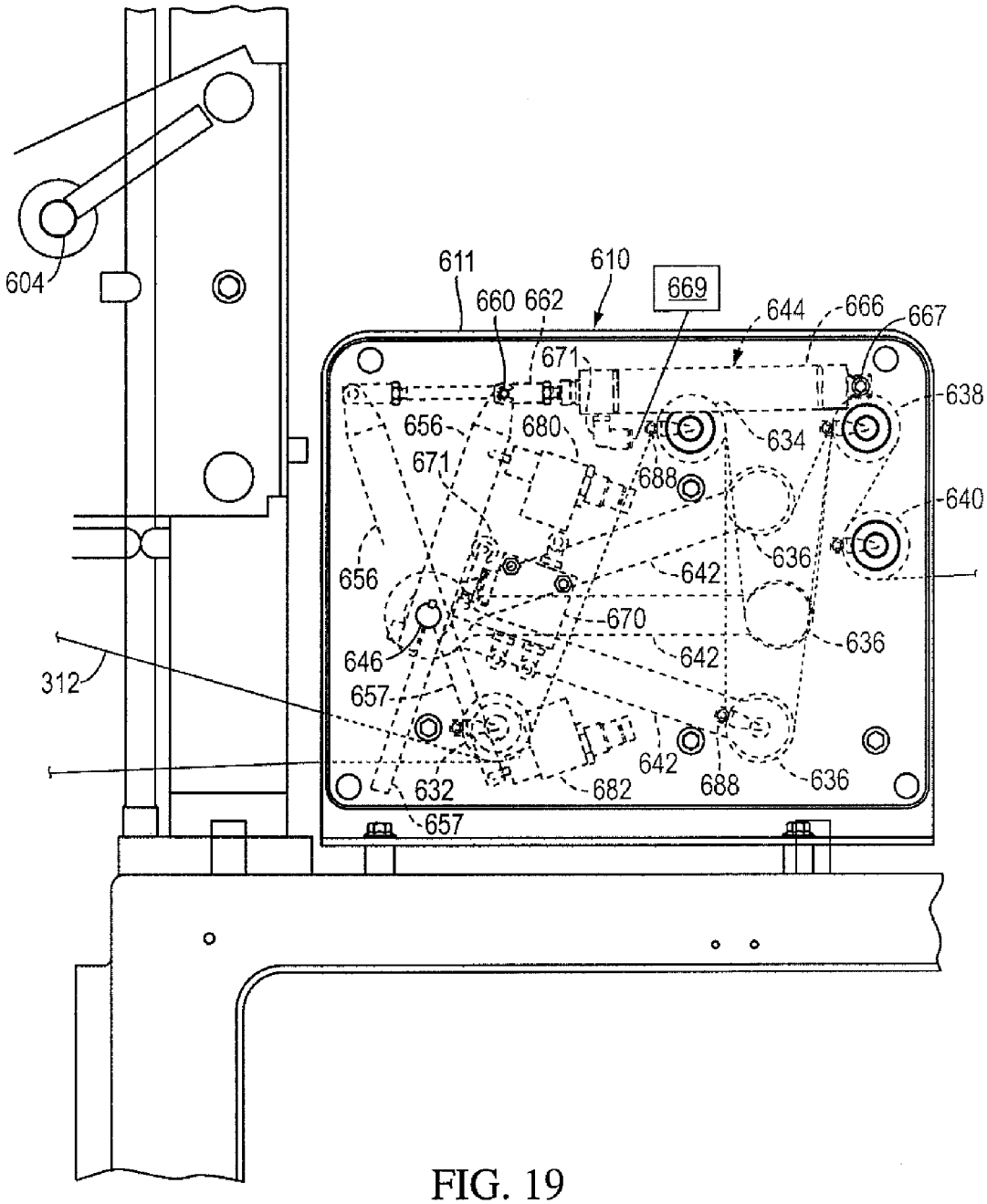
FIG. 19 is an enlarged diagrammatic sectional view of a tension controlling station of the sheet interleaving mechanism of FIG. 18.

FIG. 19 illustrates the tension control station 610 in more detail. The station 610 includes a housing or frame 611. The web material 312 is first threaded around a first fixed lower idle roller 632 and is then directed upward to wrap around a first upper fixed idle roller 634. The web material 312 is then directed downward to wrap a dancer roller 636 and then directed upward to wrap a second upper fixed idle roller 638. The web material 312 is then directed downward to wrap a second lower fixed idle roller 640 and then directed substantially horizontally out of the station 610. The dancer roller 636 is mounted on a lever 642 that can be pivoted about a pivot attachment 646 to the frame 611 of the station 610. A lever arm 656 is clamped and pinned to the lever 642 to rotate therewith. The lever arm 656 includes a tail portion 657 below the attachment 646. The rollers 632, 634, 638, and 640 are all rotatably attached to the frame 611.

The lever arm 656 is rotatably attached at connection 660 to an extendable rod 662 of a pneumatic actuator 664. The pneumatic actuator 664 includes a cylinder 666 that is pinned at connection 667 to the frame 611. Controlled pneumatic pressure delivered into the cylinder 666 extends or retracts the rod 662. Pressurized air is pneumatically connected by a circuit to the cylinder 666. The circuit includes a pressure compensating pressure regulator 669 (shown schematically) delivering pressurized air into an inlet 671 to maintain a consistent pressure in the pneumatic cylinder 666 regardless of the travel of the rod 662. The air pressure within the cylinder 666 urges the rod 662 to the right in the figure. Given typical surrounding parameters, this pressure can be about 12 psig. This consistent force on the arm 656 creates a consistent tension in the web material 312 by the downward force from the dancer roller 636 on the web material 312 caused by torque on the arm/lever assembly 656, 642 from the actuator 664. End-of-travel shock absorbers 680, 682 are contacted and engaged by extreme positions of the lever arm 656 or the tail portion 657. These shock absorbers 680, 682 cushion the end of travel of the arm 656 and tail portion 657 resulting in better tension control. Two extreme positions of the components 662, 656, 657, 642, 636 are shown. An intermediate, normal position of the components 642, 636 is also shown.

Additionally, grounding tabs 688 are applied to the idle rollers to eliminate any static buildup produced during the feeding of the web material 312 over metal rollers. Static buildup can have a negative effect on any solid-state machine controls.

A manually activated valve 670 is provided within the frame 611. This valve includes a switch arm or lever 671 that is located to be triggered when the lever arm 656 reaches close to its extreme clockwise rotation, when the rod 662 is drawn to an extreme position to the right, fully retracted into the cylinder 666, and the dancer roller 636 is located at a low position. The valve 670 is pneumatically connected to a source of pressurized air and to the disc brake assembly 606 of the web material supply 601 as shown in FIG. 19A.

FIG. 19A illustrates a spool control circuit 672. The valve 670 of the tensioning station is connected to a supply of pressurized air. Preferably, a pressure regulator 673 delivers pressurized air into the valve 670. The valve 670 is configured to be normally closed, such as by a spring, blocking air flow through the valve 670. The disc brake assembly 606 of the web material supply 601 includes opposing brake pads 674*a*, 674*b* that are carried by a housing 675. The pad 674*b* is movable toward and away from the disc 605 by a pneumatic cylinder actuator 676. The outlet of the valve 670 is pneumatically connected to the actuator 676. When the lever arm 656 pushes the lever or switch arm 671 the valve 670 is opened, and the actuator 676 receives pressurized air from the valve 670. The force of the pressurized air within the actuator 676 causes the pad 674*b* to overcome the urging of a spring 677 that urges the pad 674*b* away from the disc 605, to clamp the pads 674*a*, 674*b* onto the disc 605 to stop spinning of the spool. The dancer roller 636 will begin to rise from tension force from the web material 312 and the lever arm 656 will disengage the switch arm or lever 671 which will close the valve 670. The spring 677 will move the pad 674*b* away from the disc 605 and the disc 605 will be free to spin and dispense more web material 312. The dancer roller 636 will begin to fall until the lever arm 656 once again opens the valve 670 and the process repeats.

The valve 670 can be a solenoid electric/pneumatic type valve wherein the switch arm 671 is an electrical switch, or it can be a pneumatic valve wherein the lever 671 is a mechanical valve actuator.

Although the described control system provides for an oscillating movement of the dancer roller 636 and an oscillating engagement of the brake 606, it is encompassed by the invention that a set-point type control of the dancer roller position could be employed wherein the braking force on the disc is substantially continuous but modulated in force or duration to keep the dancer roller 636 at a desired position or within a desired range of positions.

Figure 20:
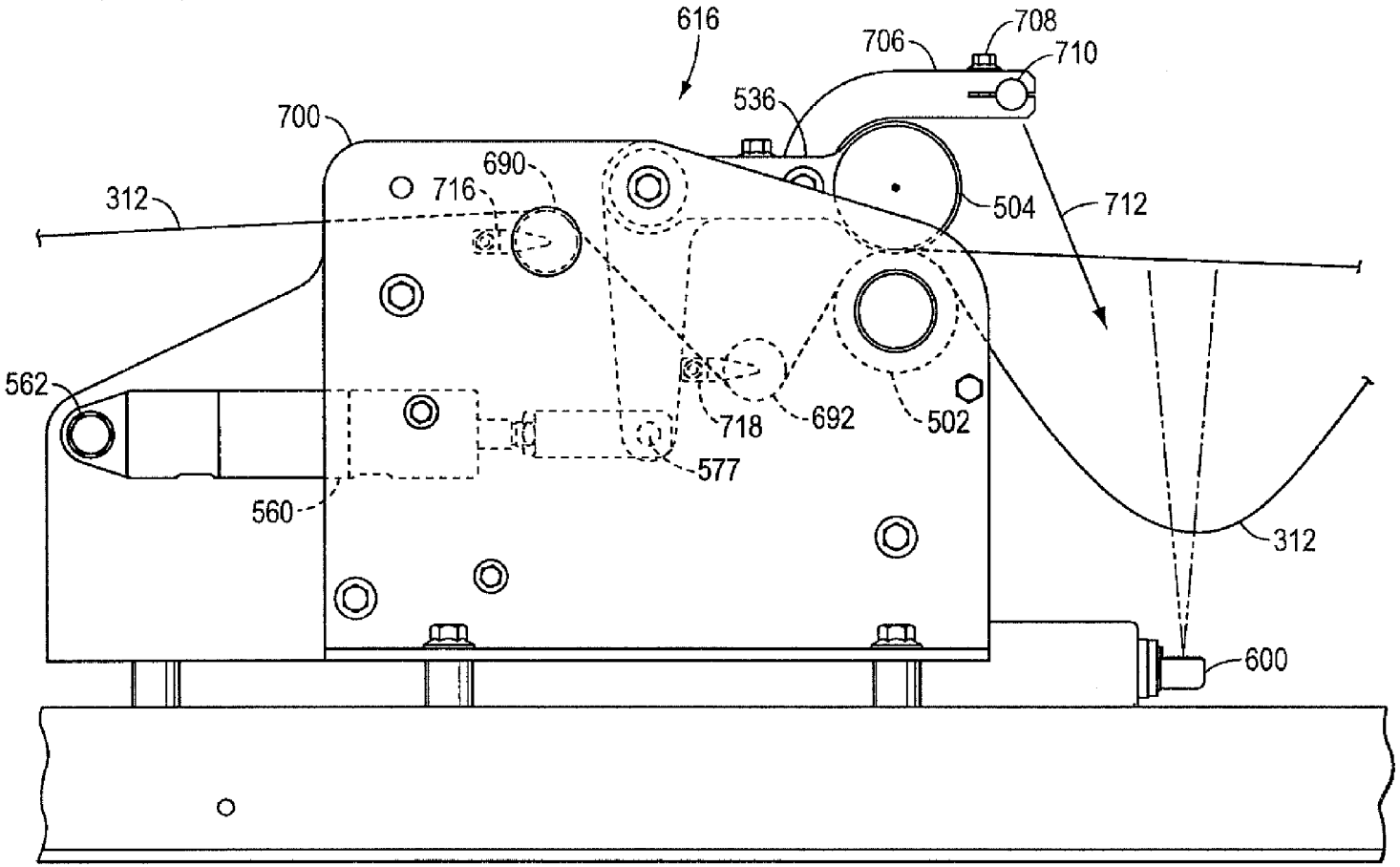
FIG. 20 is an enlarged diagrammatic sectional view of an unwinding station of the sheet interleaving mechanism of FIG. 18.
Figure 21:
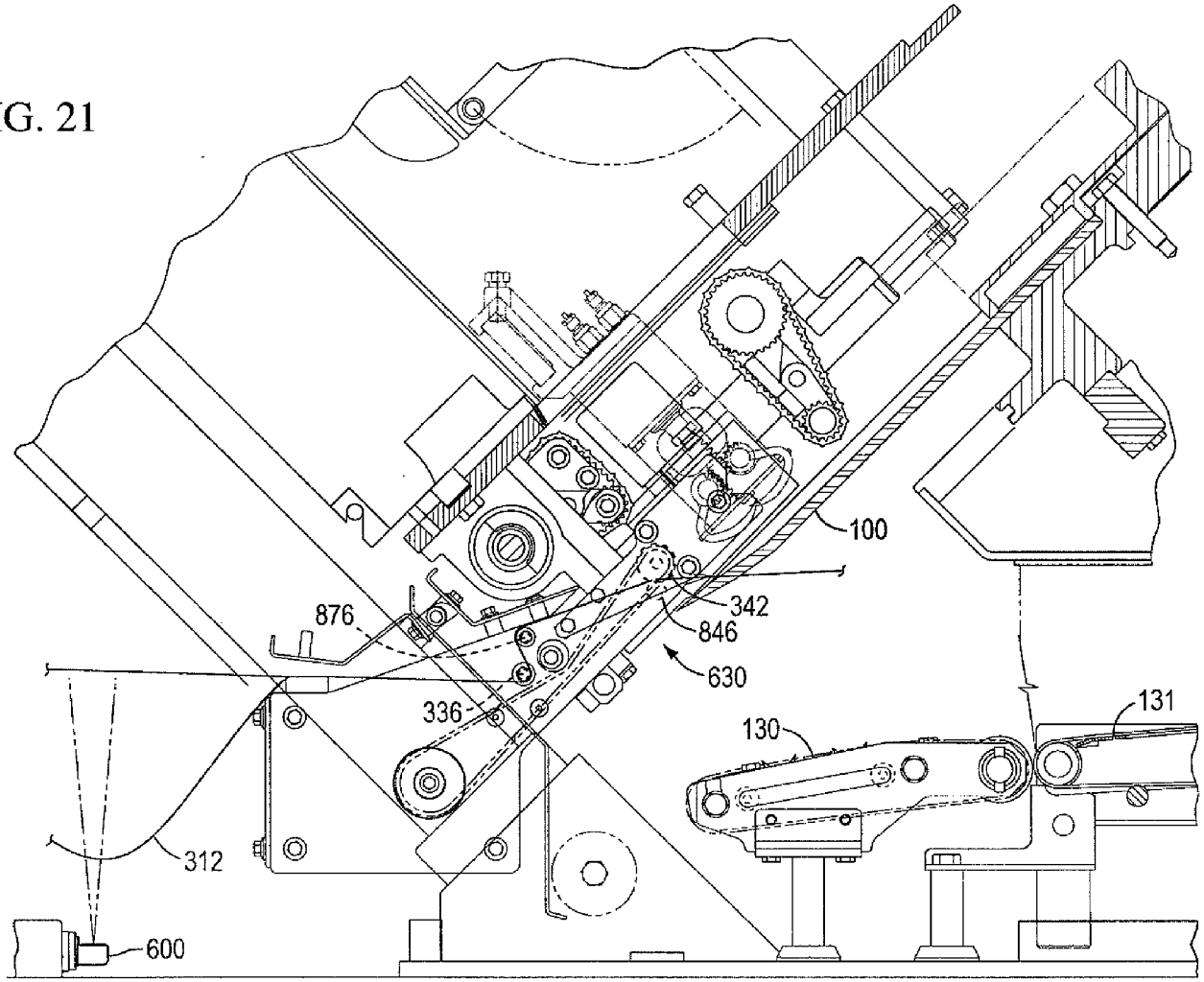
FIG. 21 is a fragmentary enlarged view of a feed station of the sheet interleaving mechanism of FIG. 18.
Figure 22:
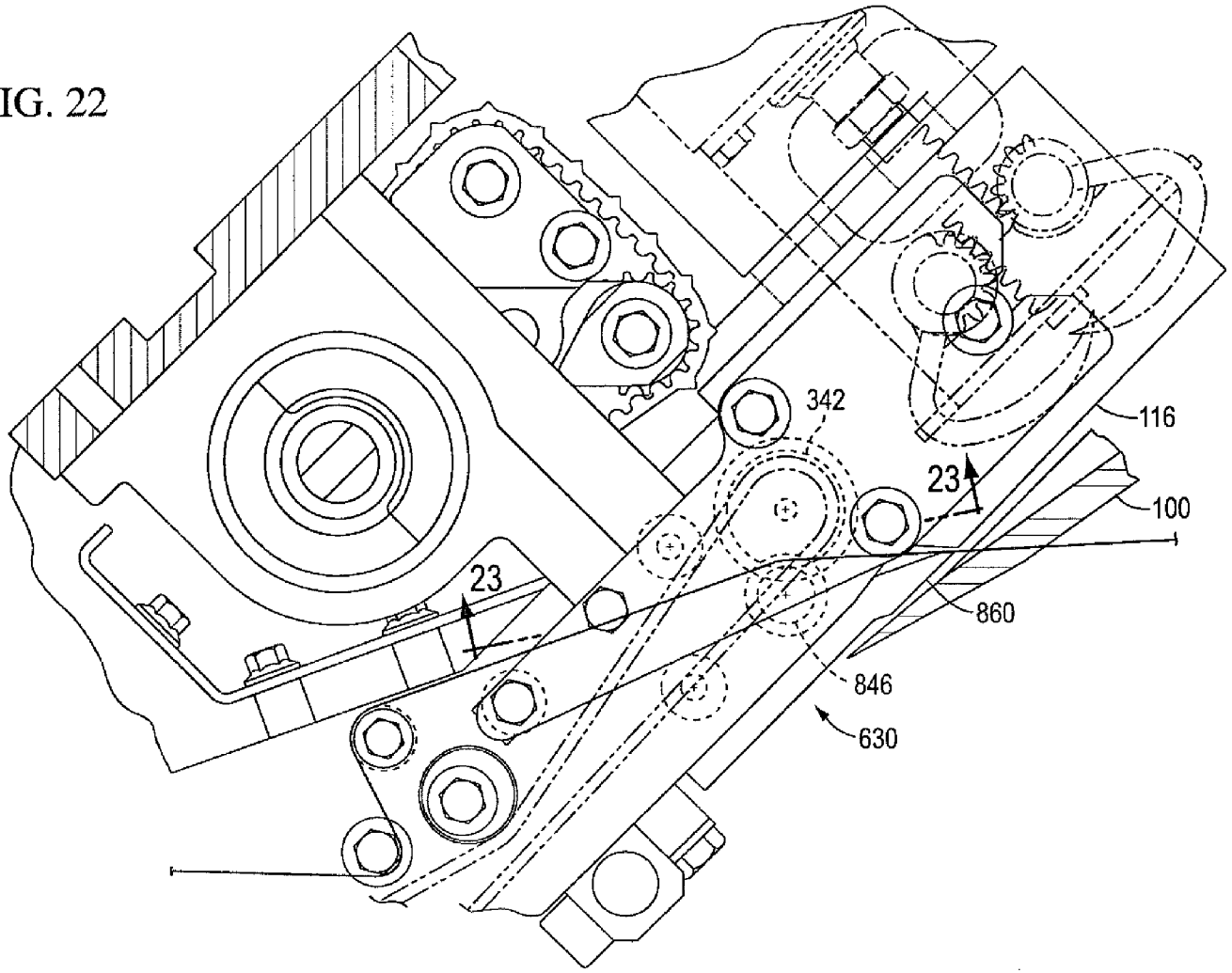
FIG. 22 is a further enlarged view of the feed station of the sheet interleaving mechanism of FIG. 21.
Figure 23:
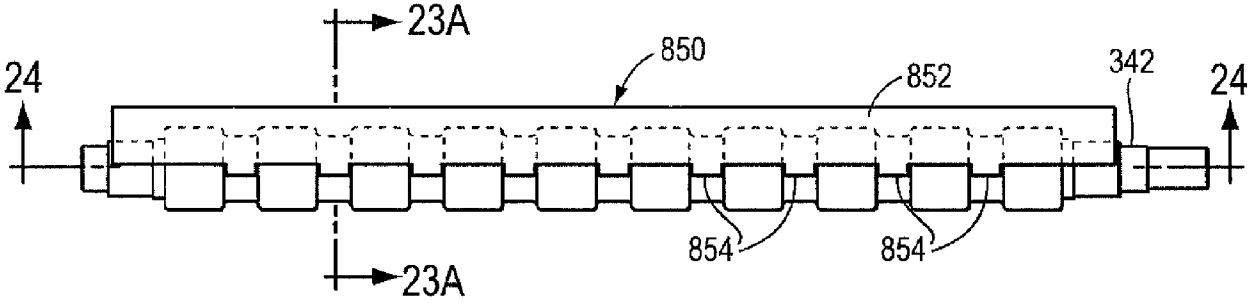
FIG. 23 is a sectional view taken generally along line 23-23 of FIG. 22.
Figure 24:
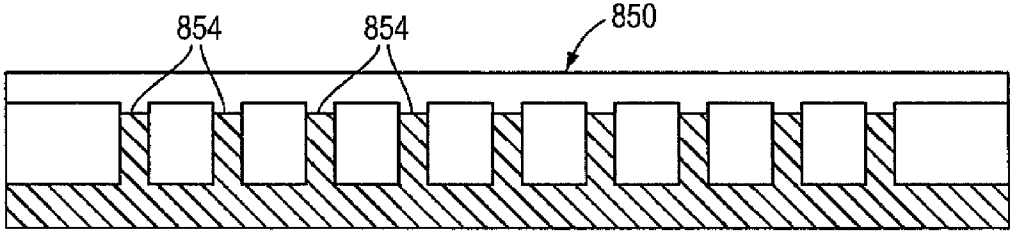
FIG. 24 is a sectional view taken generally along line 24-24 of FIG. 23.
Figure 25:
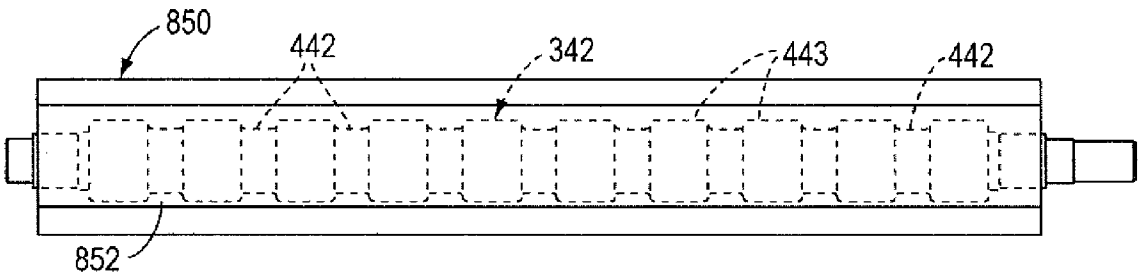
FIG. 25 is a top view of FIG. 23.

FIG. 20 illustrates the web material draw station or unwind station 616. The unwind station 616 includes modifications to the previously described unwind station 316. Particularly, the web material 312 entering the unwind station is wrapped around an upper fixed idle roller 690 and then a lower fixed idle roller 692 which are mounted to a station frame 700. After the lower fixed idle roller 692, the web material 312 is wrapped around the driven roller 502. By the use of the two idle rollers 690, 692, the web material 312 can be wrapped around the driven roller 502 to a greater extent for more traction and control.

Also, a bracket 706 is mounted to the lever 536 and extends to a clamp arrangement 708. An air dispensing tube 710 is mounted to the bracket 706 and is configured to have orifices to dispense pressurized air in one or more streams 712 directed downward into the web material 312 that is located between the unwind station 616 and the feed station 630. Impingement or pressure from the streams 712 causes a slight tension in the slackened web material 312 to enhance the controllability and functionality of the sensor 600. The slight tension results in a uniform tension of the web material 312 to the feed station 630.

Additionally, grounding tabs 716, 718 are applied to the idle roller 690, 692 to eliminate any static buildup produced during the feeding of the web material 312 over metal rollers. Static buildup can have a negative effect on any solid-state machine controls.

FIGS. 21-25 illustrate the modified feed station 630 compared to the prior described feed station 330. The pinch roller 346 of the prior described embodiment is replaced with a pinch roller 846 having a resilient outer layer for interaction with the web material 312 pinched between the drive roller rings 443 and the pinch roller 846. The pinch roller 846 can have the resilient outer layer over the entire length or only located at the rings 443 of the driven roller 342.

A scraper or comb plate 850 is mounted stationary in close proximity to the driven roller 342. The comb plate has a base 852 and finger portions 854. The finger portions 854 are spaced apart to correspond to the positions of the grooves or recesses 442. The fingers 854 each proceed into a groove 442 as shown in FIG. 23A. The fingers 854 act to separate the web material 312 from the surface of the driven roller 342 and direct the web material 312 straight into an alternate cutting nip 855. A modified shearbar or cutting guide 860 can have a curved, concave groove 862 that forms a deflecting surface that closely conforms to the pinch roller 846 to also help separate the web material 312 from the pinch roller 846 and direct the web material 312 straight into the cutting nip 855. The cutting nip 855 is defined between the loaf guide 166 and the comb plate 850, and the cutting guide 860.

Figure 26:
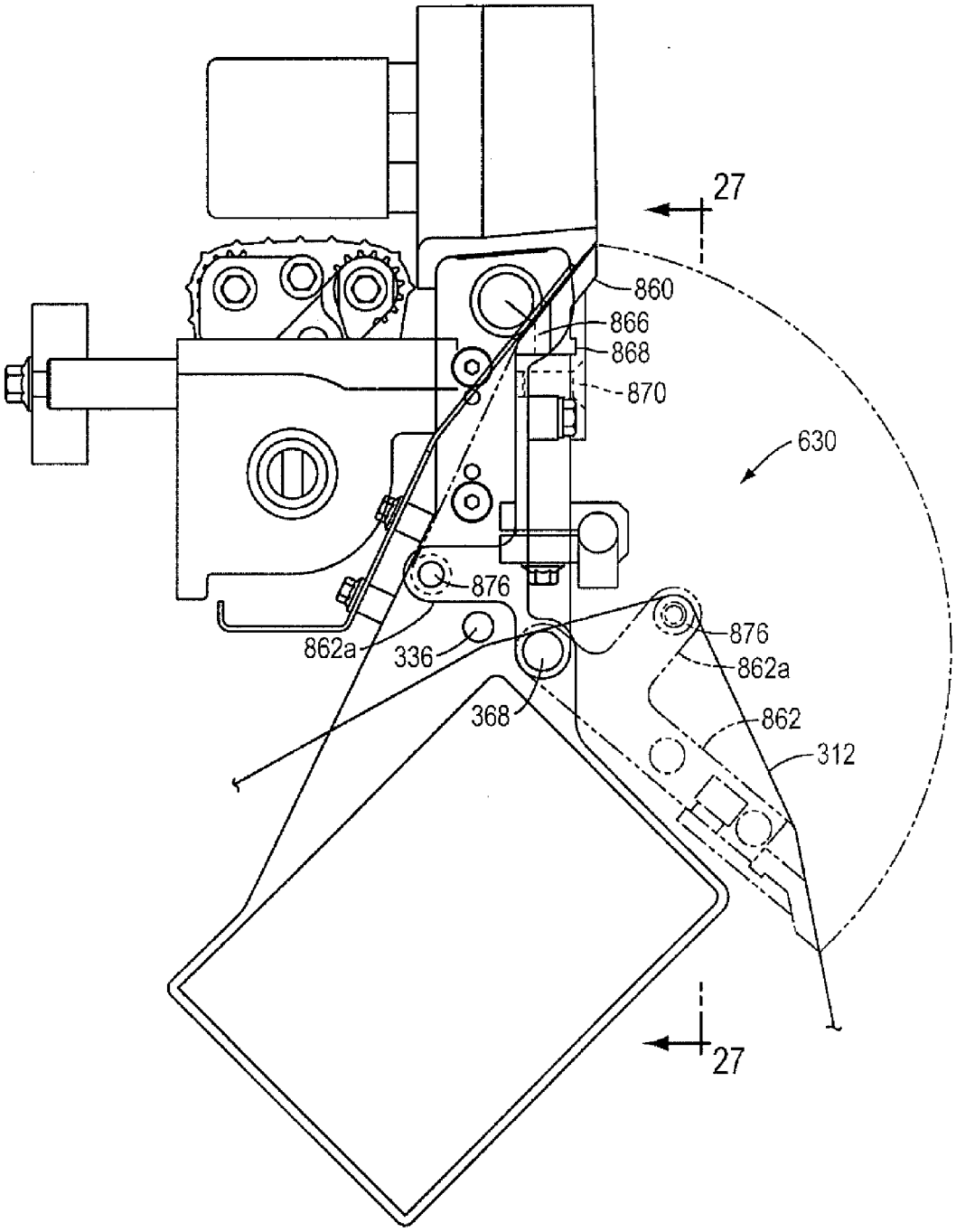
FIG. 26 is a sectional view similar to FIG. 22 but showing the feed station of FIG. 22 in an open configuration.
Figure 28:
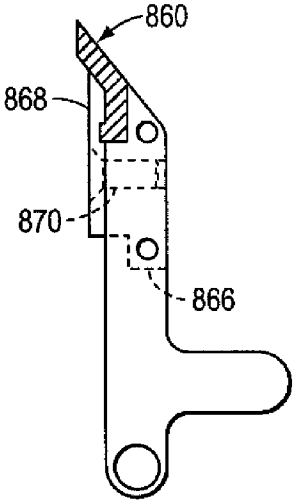
FIG. 28 is a sectional view taken generally along line 28-28 of FIG. 27.
Figure 27:
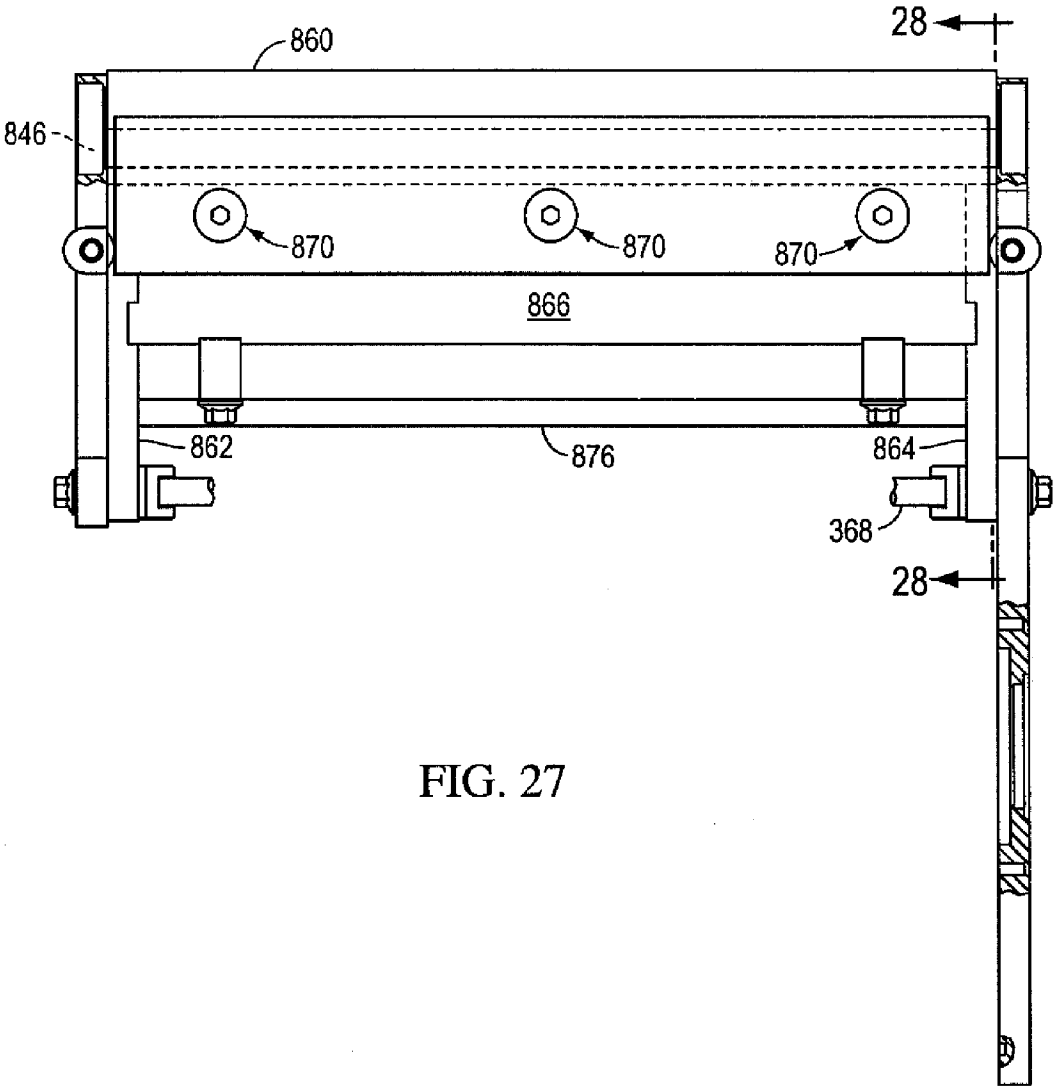
FIG. 27 is a view taken generally along line 27-27 of FIG. 26.

FIGS. 26-28 illustrate further aspects of the modified feed station 630. The feed station 630 is shown in both the closed (solid) and open positions (dashed). The open position is for the purpose of initially threading the web material 312 between the elements of the cutting nip 855 and between the rollers 342, 846. The cutting guide 860 is mounted to opposite inside support plates 862, 864 by being clamped between a bridge plate 866 that is fastened to the support plates 862, 864, and a clamp plate 868. Three fasteners 870 clamp the clamp plate 868 to the bridge plate 866, capturing the shear bar 860, which can be dovetailed into the clamp plate 870. To replace the shearbar 860, when the feed station 630 is opened, the fasteners 870 are loosened. This loosens the clamp plate 868 and the shearbar 860 can be slid out to the side. For simplicity, the concavity 862 is not shown in FIG. 28. Also, the pinch roller 846 spans between and is rotatably mounted to the support plates 862, 864.

As shown in FIG. 27, the support plates 862, 864 include perpendicular arms 862*a*, 864*a* that rotatably mount opposite ends of an idle roller 876. The idle roller 876 is an additional roller compared to the prior described feed station 330. When in the open condition, the web material 312 is pulled over the idle roller 876 and over the shearbar 860. When closed, the shearbar 860 forms the cutting nip with the loaf guide 116, the rollers 342, 846 pinch the web material 312, and the idle roller 376 wraps the web material 312 and directs the web material over the idle roller 336.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

The invention claimed is:

1. A sheet interleaver for a slicing machine that provides a slicing plane for slicing an elongated food product and a sheet from web material beneath said elongated product, comprising:

a supply of web material;

a drawing station having a first driver for drawing web material from said supply;

a feed station having a second driver for receiving web material from said drawing station and driving said web material through a cutting nip into said slicing plane;

a controller in signal-communication with said first and second drivers to drive web material at select differential speeds by said first and second drivers such that tension of the web material between said drawing station and said feed station is controlled; and a non-contact sensor that senses tension of web material between said drawing station and said feed station and is in signal-communication with said controller to adjust the differential speed of said first and second drivers to maintain said tension within a pre-selected range.

2. The sheet interleaver according to claim 1, wherein said tension is controlled by said controller to allow a slackened length of web material between said drawing station and said feed station that is greater than a straight line distance of the web material spanning between said drawing station and said feed station.

3. The sheet interleaver according to claim 2, further comprising a tensioning station between said supply and said drawing station such that tension of said web material between said drawing station and said supply is controlled.

4. The sheet interleaver according to claim 1, wherein said supply comprises a roll of web material on a spool.

5. The sheet interleaver according to claim 4, wherein said supply comprises a non-contact sensor that sends a signal to said controller corresponding to the amount of web material on said spool.

6. The sheet interleaver according to claim 1, further comprising a tensioning station between said supply and said drawing station such that tension of said web material between said drawing station and said supply is controlled, wherein said tensioning station comprises a dancer roller mounted on a pivotable lever and a urging device that exerts a controllable force on said lever.

7. The sheet interleaver according to claim 6, wherein said urging device comprises a pneumatic cylinder actuator having a body and an extendable cylinder rod, one of said body and said rod fixed in position and the respective other of said body and said rod connected to said lever.

8. The sheet interleaver according to claim 1, wherein said tension is controlled by said controller to allow a slackened length of web material between said drawing station and said feed station that is greater than a straight line distance of the web material spanning between said drawing station and said feed station; and wherein said non-contact sensor senses the slackened length of web material between said drawing station and said feed station and is in signal-communication with said controller to adjust the differential speed of said first and second drivers to maintain said slackened length at a pre-selected amount.

9. A sheet interleaver for a slicing machine that provides a slicing plane for slicing an elongated food product and a sheet from web material beneath said elongated product, comprising:

a supply of web material;

a drawing station having a first driver for drawing web material from said supply;

a feed station having a second driver for receiving web material from said drawing station and driving said web material through a cutting nip into said slicing plane;

a controller in signal-communication with at least one of said first and second drivers to drive web material at select differential speeds by said first and second drivers such that tension of the web material between said drawing station and said feed station is controlled;

wherein said second driver comprises opposing rollers wherein at least one of said rollers is motor driven and said rollers are pressed together with a resilient interface and roll in opposite directions to form a pinch nip for receiving and driving said web material; and wherein said resilient interface is discontinuous along a lateral direction of said pinch nip.

10. The sheet interleaver according to claim 9, wherein one of said opposing rollers comprises annular recesses spaced apart along said lateral direction and a respective other of said opposing rollers has annular rings that are arranged to fit within said annular recesses, wherein the interaction of said annular recesses and annular rings causes said web material driven by said pinch nip to assume a corrugated profile downstream of said pinch nip.

11. The sheet interleaver according to claim 9, wherein one of said opposing rollers comprises annular recesses spaced apart along said lateral direction and a respective other of said opposing rollers has a smooth annular surface.

12. The sheet interleaver according to claim 11, further comprising a comb plate having a base portion fixed in close proximity to said pinch nip and finger portions that fit into said recesses, said comb plate configured to prevent said web material from wrapping around said one roller.

13. The sheet interleaver according to claim 12, further comprising a bottom deflecting surface, said bottom deflecting surface fixed in position in close proximity to said pinch nip and having a portion that partially curves around said other roller, said deflecting surface plate configured to prevent said web material from wrapping around said other roller.

14. A sheet interleaver for a slicing machine that provides a slicing plane for slicing an elongated food product and a sheet from web material beneath said elongated product, comprising:

a supply of web material;

a drawing station having a first driver for drawing web material from said supply;

a feed station having a second driver for receiving web material from said drawing station and driving said web material through a cutting nip into said slicing plane;

a controller in signal-communication with at least one of said first and second drivers to drive web material at select differential speeds by said first and second drivers such that tension of the web material between said drawing station and said feed station is controlled; and a tensioning station between said supply and said drawing station such that tension of said web material between said drawing station and said supply is controlled.

15. A sheet interleaver for a slicing machine that provides a slicing plane for slicing an elongated food product and a sheet from web material beneath said elongated product, comprising:

a supply of web material;

a drawing station having a first driver for drawing web material from said supply;

a feed station having a second driver for receiving web material from said drawing station and driving said web material through a cutting nip into said slicing plane;

a controller in signal-communication with at least one of said first and second drivers to drive web material at select differential speeds by said first and second drivers such that tension of the web material between said drawing station and said feed station is controlled;

wherein said tension is controlled by said controller to allow a slackened length of web material between said drawing station and said feed station that is greater than a straight line distance of the web material spanning between said drawing station and said feed station; and a pressurized air dispenser that is configured to direct an air stream onto a side of said slackened length to maintain a tension on said slackened length of web material.

* * * * *